US005570568A

United States Patent [19]

Kramer

[11] Patent Number: 5,570,568

[45] Date of Patent: Nov. 5, 1996

[54] BAGGING CONTROL APPARATUS AND METHOD

[75] Inventor: James D. Kramer, Medina, Ohio

[73] Assignee: Automated Packaging Systems, Inc., Streetsboro, Ohio

[21] Appl. No.: 241,971

[22] Filed: May 12, 1994

Related U.S. Application Data

[62] Division of Ser. No. 936,925, Aug. 27, 1992, Pat. No. 5,341,625.

[51] Int. Cl.[6] ..... B65B 51/14; B65B 7/06; B65B 57/00

[52] U.S. Cl. ..... 53/479; 53/75; 53/77; 53/373.7; 53/374.9; 156/358; 156/359

[58] Field of Search ..... 156/350, 351, 156/352, 358, 359, 365, 367, 583.1, 583.2; 219/248, 250; 53/479, 374.9, 374.8, 570, 75, 77, 469, 481, 389.2, 389.4, 389.5

[56] References Cited

U.S. PATENT DOCUMENTS

| | | | |
|---|---|---|---|
| 3,815,318 | 6/1974 | Lerner | 53/374.9 X |
| 3,956,866 | 5/1976 | Lattur | 53/570 X |
| 3,965,653 | 6/1976 | Lerner | 53/374.8 X |
| 4,546,596 | 10/1985 | Cherney | 53/75 X |
| 4,713,047 | 12/1987 | Klinkel | 156/358 X |
| 5,051,148 | 9/1991 | Resch | 156/358 |
| 5,094,061 | 3/1992 | Evers | 53/570 X |
| 5,147,491 | 9/1992 | Thomas et al. | 53/75 X |
| 5,154,037 | 10/1992 | Focke | 53/389.4 X |
| 5,289,671 | 3/1994 | Lerner et al. | 53/479 |
| 5,322,586 | 6/1994 | McLean | 156/358 |

*Primary Examiner*—Horace M. Culver

[57] ABSTRACT

A packaging machine and method for simultaneously loading, sealing and severing bags. A first stepper motor, having an output, is coupled to a nip roll assembly. After a bag is loaded, a sealing mechanism is actuated to seal the loaded bag or bags. A sensor monitors movement in a pressure bar and terminates the sealing cycle if a jam is detected before the pressure bar engages a seal bar having a heater for sealing the bag. The stepper motor is used to retract bags and sever a leadmost bag that is clamped between the seal bar by the pressure bar. A second stepper motor withdraws the web from a supply at a controlled rate to maintain tension in the web between the first and second stepper motors. A dancer roll assembly includes an orientation sensor for controlling the second stepper motor to speed up, slow down or stop.

7 Claims, 19 Drawing Sheets

BAGGING CONTROL APPARATUS AND METHOD

This is a divisional of application Ser. No. 07/936,925 filed on Aug. 27, 1992, now U.S. Pat. No. 5,341,625.

TECHNICAL FIELD

The present invention relates generally to packaging systems and in particular to a method and apparatus for forming packages by sequentially loading and separating bags from a chain or web of bags.

BACKGROUND ART

Various methods and apparatus for packaging articles in plastic bags are available today or have been suggested in the past. In one packaging method, the bags form part of a continuous plastic web, each bag being connected to a contiguous bag along a line of weakness. Typically, the bags define an opening on one face through which the bag is loaded.

In early bagging machines, an operator manually loaded the product into the bag and the bag was pulled downwardly to position the next bag at the loading station. The loaded bag was then manually severed from the web.

Machines and methods for automatically loading a chain of interconnected plastic bags have been developed or have been suggested by the prior art. In general, these machines include a mechanism for sequentially feeding a lead bag to a loading station; a mechanism for expanding the mouth of the bag and maintaining it in the expanded condition during a loading operation; and, a mechanism for severing the loaded bag from the chain. After the loaded bag is severed, the packaging sequence begins again with the next bag.

The individual bags are usually joined to the chain or web by a line of weakness generally formed by a plurality of perforations. After the bag is loaded, it is severed from the web along the perforations. Various mechanisms for automatically severing the loaded bag from the web have been developed or suggested. In one known method, the separation along the perforations is initiated by a projection that begins the tearing action near the center of the line of weakness. Severance of the bag then commences at the center of the line of weakness and proceeds outwardly toward the marginal edges. An example of such a mechanism is shown in U.S. Pat. No. 3,477,196, which is owned by the present assignee.

An alternate method for severing a loaded bag from a web is disclosed in U.S. Pat. No. 4,202,153 which is also owned by the present assignee. In the method and apparatus shown in this patent, a transversely movable product carrier enters an opened bag, positioned horizontally, and simultaneously loads the bag and severs it from the web. Severance is achieved by overdriving the product carrier so that it engages the bottom of the loaded bag and drives it away from the web while the remainder of the web is held stationary, thus tearing the loaded bag from the web. In the disclosed apparatus, the perforation breakage commences near the marginal edges of the web and advances inwardly from the marginal edges toward the center. Because the perforations are broken serially, the force needed to sever the container is less than that required if the perforations were broken simultaneously.

In U.S. Pat. No. 3,815,318 (also owned by the present assignee), a packaging method and apparatus is disclosed which illustrates another apparatus for severing a loaded bag along a line of weakness. In this apparatus, the tearing action is produced by a pivoting mechanism which engages a loaded bag and pivots the bag about an axis located near one marginal edge while the web is held stationary. The tearing action then commences at a remote marginal portion and advances towards the edge of the bag that is located at or near the pivot axis.

A method and apparatus for simultaneously filling two adjacent bags have also been suggested in the past. In particular, U.S. Pat. No. 4,041,846, owned by the present assignee, illustrates detachable, interconnected container strips and a method of making these strips. The strips are connected in a side-by-side relationship in order to define adjacent bags. In this patent, however, the adjacent bags are attached and cannot move independently of each other prior to filling. After filling, the attached side-by-side bags are separated.

A machine described in U.S. Pat. No. 4,899,520 entitled "Packaging Apparatus and Method" also includes an ability to use two chains of interconnected bags while packaging. After bags are loaded, they are sealed with a heater bar which melts adjacent plastic plys to fuse them together. During the sealing operation, the weight of the bag's contents and bag separation forces are isolated from the region of the seal by spring biased grippers that are moved into engagement with a bag by a clamping sub-assembly that also brings the bag into contact with the sealer bar.

U.S. Pat. No. Re. 32,963 to Lerner et al. discloses a packaging machine for loading a chain of interconnected bags. A gripper assembly clamps the bag to be loaded to a funnel mechanism. An incremental reversing mechanism retracts the web of bags after the endmost bag is loaded to sever the bag from the web along a line of weakness.

DISCLOSURE OF THE INVENTION

A bagging machine constructed in accordance with one embodiment of the invention includes structure establishing a path of travel for a web of interconnected bags connected along transversal lines of weakness from a supply roll to a bagging station. A nip roll assembly includes first and second rollers for selectively advancing the web from the supply roll to the bagging station. A drive motor is operatively connected to one roller of the nip roll assembly. A control selectively actuates the motor in order to advance the web through the nip roll assembly at a controlled rate to maintain a controlled tension in the web between the supply roll and the nip roll assembly.

In the preferred embodiment, the control includes a microprocessor controller which activates two stepper motors for advancing the web. One stepper motor moves the web in the vicinity of the bagging station in increments to allow a lead bag to be positioned at the bagging station while an operator loads and seals the bag. Tear off of this lead bag is accomplished by reverse activating the stepper motor to sever the lead bag which is clamped by a seal mechanism.

The second stepper motor unwinds the plastic web from a supply. Most typically, the supply is a roll of material mounted for rotation to the bagging machine. As the first stepper motor incrementally advances the web to the bagging station, the second stepper motor unwinds the web at a rate which matches the average speed of the first motor.

The web is preferably advanced through a dancer roll assembly which comprises multiple rollers through which the web is threaded when it is mounted to the bagging machine. The dancer roll assembly is pivotally mounted to the machine and responds to actuation of the first stepper motor by raising and lowering as the rate of stepper motor activation changes. The orientation of the dancer roll assembly is monitored and used as a feedback control for activating the second stepper motor. Stated another way, as the first stepper motor brings the lead bag to the bagging station, the orientation of the dancer roll assembly is monitored and used to adjust the speed with which the material is withdrawn from the supply.

A control microprocessor performs the various functions of monitoring and controlling web movement accomplished by the stepper motors, as well as sealing of the bags. To accomplish these functions, control solenoids operatively coupled to the control microprocessor are actuated and de-actuated to energize air cylinders mounted to the bagging machine. A second controller or microprocessor mounted to the bagging machine performs the function of communications interfacing between the bagging machine and a control computer for monitoring and controlling multiple bagging machines. A preferred communications controller implements a network capability so that the bagging machine may be interconnected with counters, conveyors, imprinters and the like. Furthermore, a standard serial communications interface allows multiple baggers to communicate with a master computer for coordinating office or factory-wide operations.

An additional feature accomplished by the control microprocessor is monitoring of a bag sealing operation. In accordance with the disclosed design, sealing of an endmost bag after it has been loaded is accomplished by a pressure bar mounted for movement which engages a seal bar and clamps the endmost bag to the seal bar while the sealing operation takes place. A heater wire mounted within the seal bar fuses the plastic plys of the bag and maintains the seal while the first stepper motor is reverse-activated to sever the leadmost bag from the chain of interconnected bags.

In a most typical operation, an operator actuates a foot pedal switch to seal a leadmost bag at the bagging station. A pressure bar automatically swings towards the seal bar to seal the bag. If, during movement of the pressure bar, an obstruction is sensed by an optical sensor, the controller stops the seal motion and returns to an idle state until the obstruction is cleared.

From the above, it is appreciated that one object of the invention is the coordination of bag movement to maintain tension in the bag web regardless of the particular configuration of the bagging machine. This arrangement accommodates imprinters or other devices intermediate the web supply and the bagging head. Other objects, advantages and features of the invention will become better understood from the detailed description of a preferred embodiment which is described in conjunction with the accompanying drawings.

BEST MODE FOR PRACTICING THE INVENTION

Figure 1:
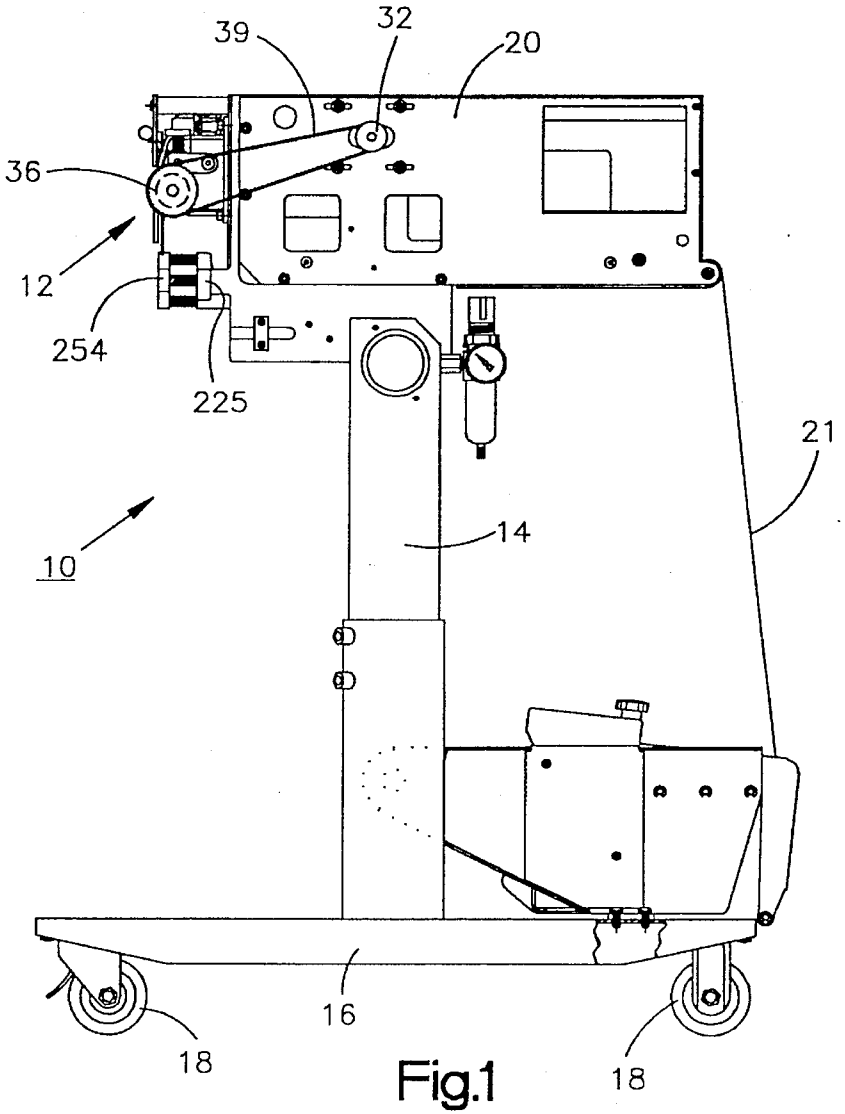
FIG. 1 is a side elevation view of a bagging machine constructed in accordance with the invention.
Figure 2:
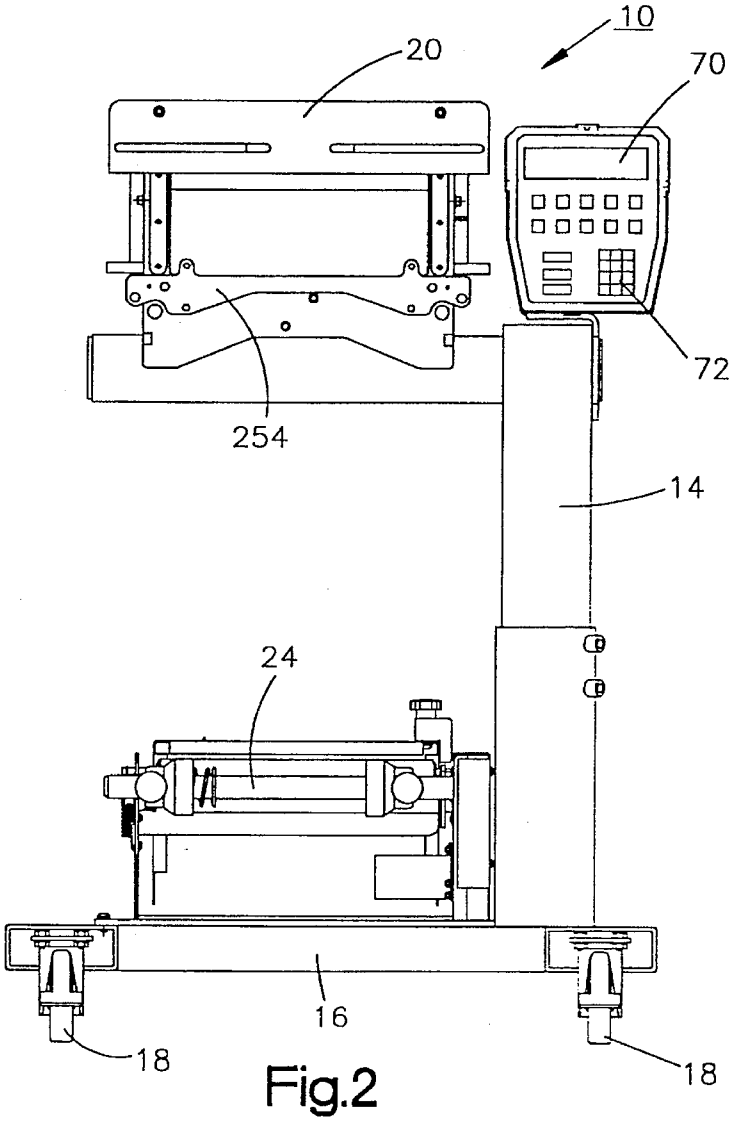
FIG. 2 is a front elevation view of the bagging machine depicted in FIG. 1.

FIGS. 1 and 2 illustrate a packaging apparatus 10 constructed in accordance with a preferred embodiment of the invention. The illustrated apparatus can be referred to as a "bagging machine" and is constructed to load bags that are interconnected to form a chain of such bags. The bags are preferably joined together along a line of weakness so that the bags can be separated from each other at a bagging station 12 where each bag is loaded with a product before it is closed, sealed and separated from the chain.

The bagging machine 10 includes a support frame 14 sitting atop a movable base 16. The base 16 is supported by rollers 18 which allow the bagging machine 10 to be moved about an office or plant. A bagging head 20 sits atop the support frame 14 and includes a housing or cover that encloses a bag-handling unit for feeding a web 21 of bags through the bagging machine from a supply roll 22 (FIG. 3) rotatably supported by the movable base 16. In the illustrated embodiment of the bagging machine 10, the supply roll 22 is supported by a rotatable spool 24 mounted to bearings 23 supported by the base 16. In an alternate use of the bagging machine, the web of bags are fed from a box having interconnected bags piled in zig-zag fashion, one layer upon another.

The bag-loading head 20 advances a lead bag to a bagging station where the bag is loaded, sealed and separated. The bagging machine 10 can be used in a manual feed mode where an operator loads individual bags with product. Alternately, the bagging machine 10 can be used in conjunction A latch circuit 126 coupled to the microprocessor 110 allows the data pins D0–D7 and the lowest eight bits of the address buss A0–A7 to be time multiplexed. A programmed array logic circuit 128 coupled to address pins A9–A15 allows the microprocessor 110 to access binary I/O buss signals I/O-0 through I/O-6 by means of memory addressable reads. All forty-eight data, address and I/O pins of the buss 108 are defined below in Table 1.

TABLE 1

| Row A | Row B | Row C |
|---|---|---|
| 1A - 1A | 1B - ANLG1 | 1C - D0 |
| 2A - BOOTSEL | 2B - ANLG2 | 2C - D1 |
| 3A - IRQ | 3B - ANLG3 | 3C - D2 |
| 4A - RESET | 4B - ANLG4 | 4C - D3 |
| 5A - E | 5B - OUT1 | 5C - D4 |
| 6A - R/W | 6B - OUT2 | 6C - D5 |
| 7A - AS | 7B - IN1 | 7C - D6 |
| 8A - PS-EN | 8B - IN2 | 8C - D7 |
| 9A - LGND[1] | 9B - A8 | 9C - I/O1 |
| 10A - ACCUM1 | 10B - A9 | 10C - I/O2 |
| 11A - ACCUM2 | 11B - A10 | 11C - I/O3 |
| 12A - 12A | 12B - A11 | 12C - I/O4 |
| 13A - 13A | 13B - A12 | 13C - I/O5 |
| 14A - 14A | 14B - A13 | 14C - I/O6 |
| 15A - +24V | 15B - A14 | 15C - 15C |
| 16A - [1] | 16B - A15 | 16C - +5V |

Figure 9:
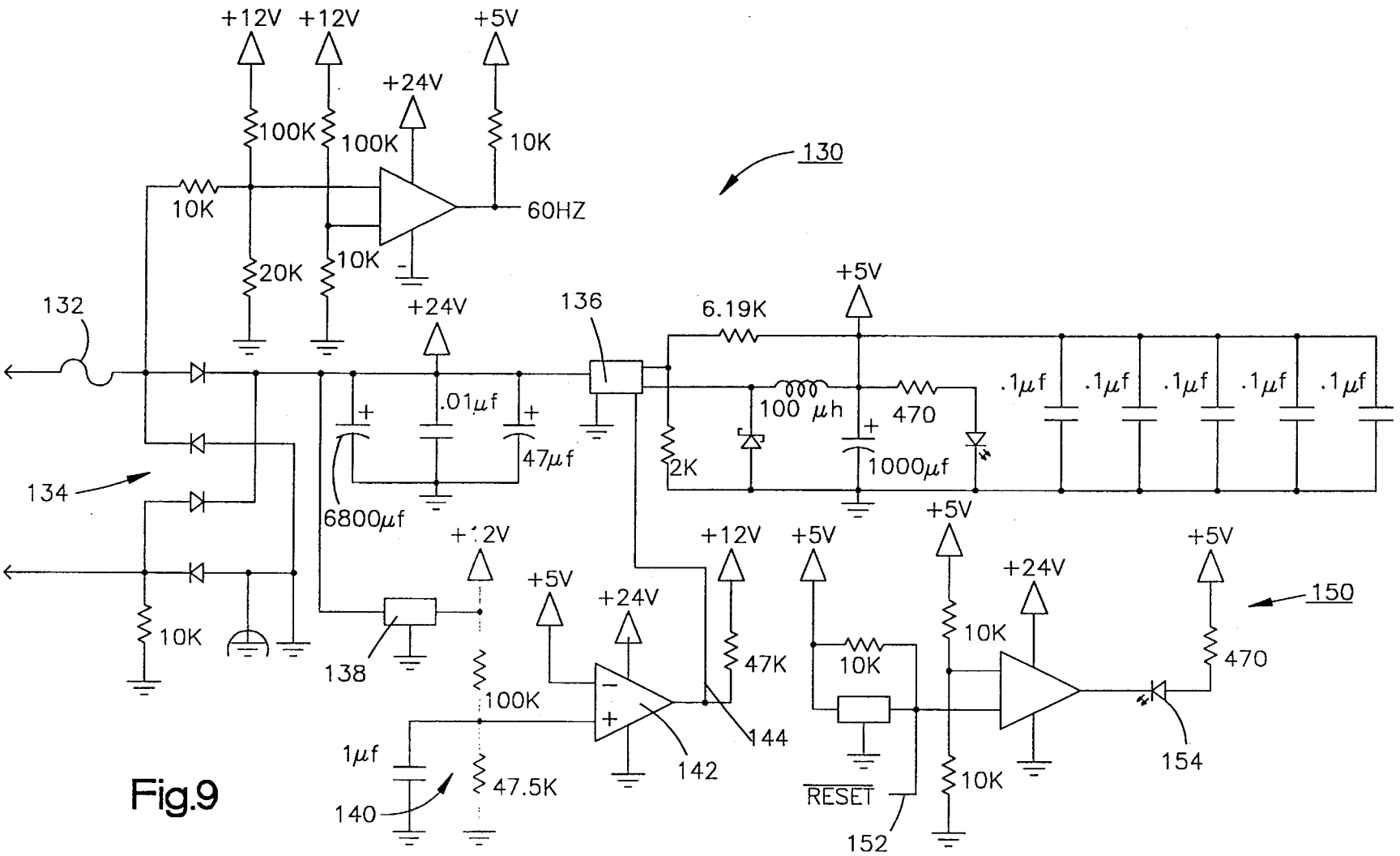
FIG. 9 is a power supply and voltage monitoring circuit.

A power supply circuit 130 (FIG. 9) is connected to a transformer 131 (FIG. 6) that converts line voltage of 110 volts to an alternating current signal of 17 volts. This 17 volt AC signal is coupled through a fuse 132 to a rectifier and filter circuit 134 which produces an input to a 5 volt regulator 136 for providing 5 volts DC for the control circuitry. The output from the rectifier and filter circuit 134 also provides a 24 volt signal to a 12 volt regulator 138 for providing a 12 volt signal. The 12 volt signal is passed through a voltage divider 140 and coupled to a comparator 142 which compares the divided voltage with a 5 volt output from the voltage regulator 136. In the event of a failure of a short circuit of the 5-volt regulator 136, an output 144 from the comparator deactivates the 5-volt regulator 136 and shuts down the bagging machine.

Immediately to the right (FIG. 9) of the comparator 142 for sensing DC voltage failure is a circuit 150 for indicating no oscillator is being generated in the control microprocessor 110. The microprocessor periodically determines whether or not it is receiving an oscillator signal and if it is not, it pulls a reset input 152 low causing a light emitting diode 154 to be activated.

Figure 8A:
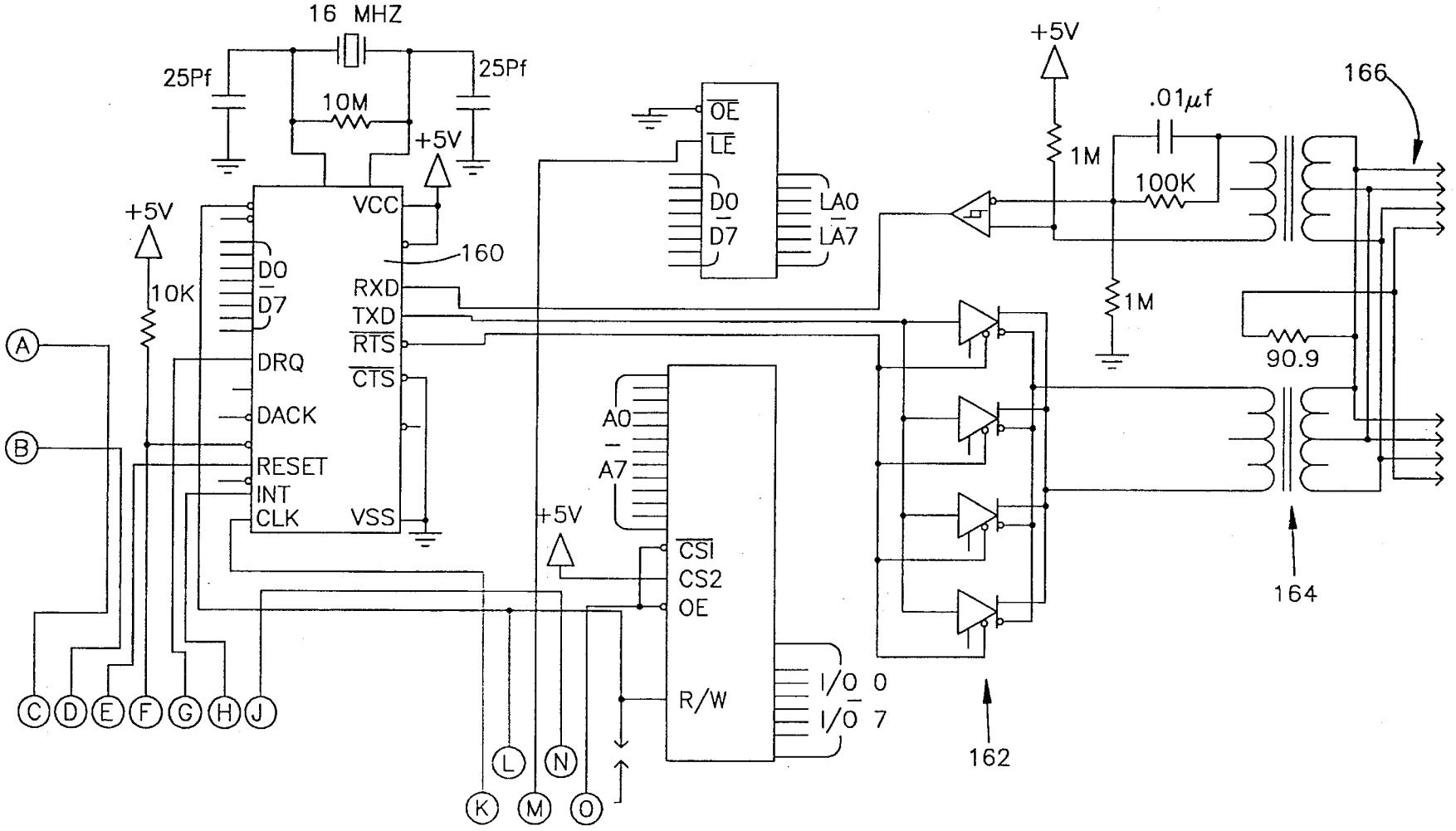
FIGS. 8A and 8B illustrate a communications interface that allows the control microprocessor of FIG. 2 to communicate with multiple other bagging machines.
Figure 8B:
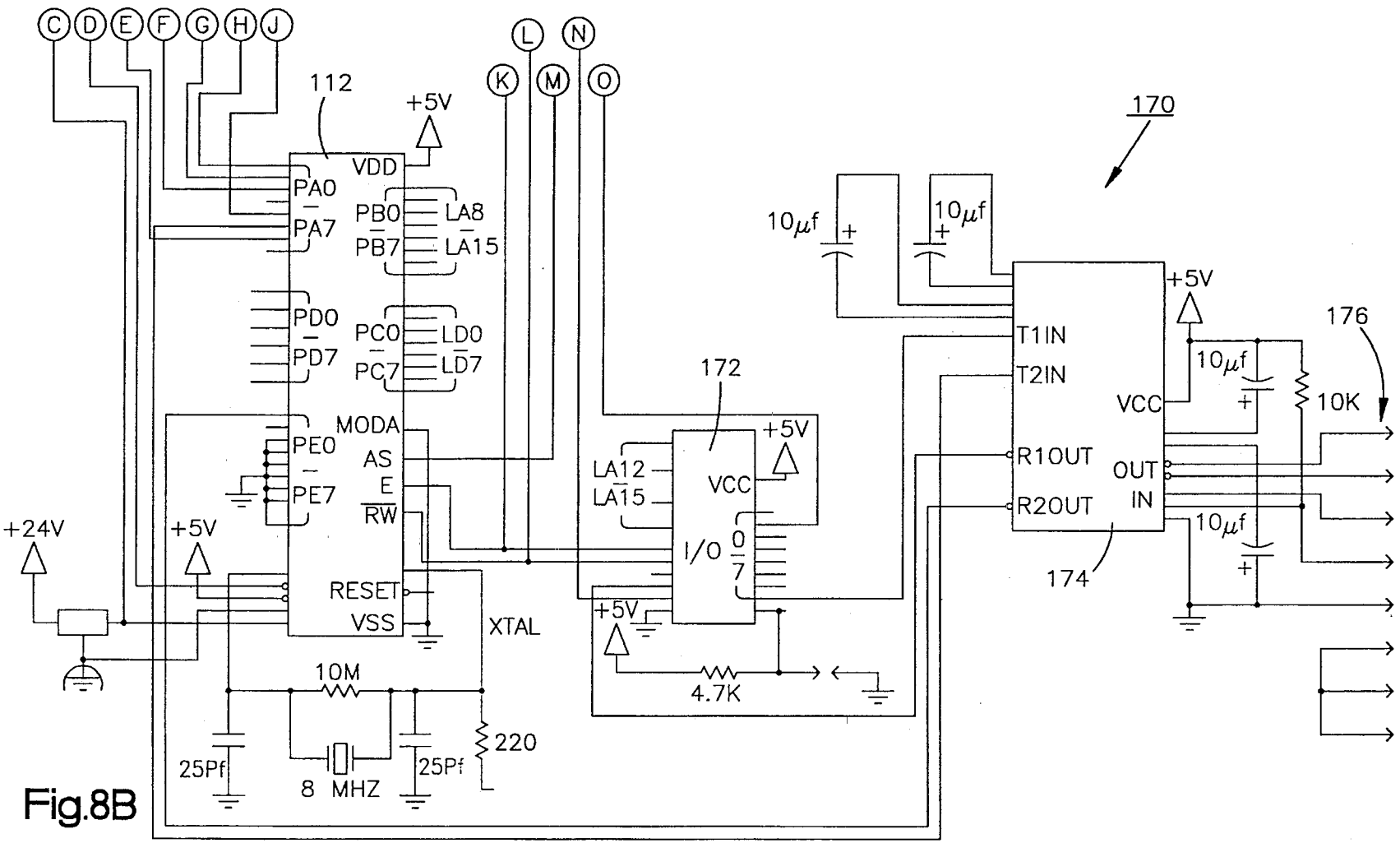

A communications microprocessor 112 (FIG. 8B) implements communications between multiple bagging machines or between multiple bagging machines and a control computer. A second communications processor 160 (FIG. 9A) is a local area network processor commercially available from Intel (Part No. D82588) for achieving serial communications. The local area network processor 160 is coupled to a driver circuit 162 which in turn is coupled to a transformer 164 for providing isolation between this circuit 160 and other serially interface circuits on other bagging machines. A transformer output 166 is coupled to a standard RJ11 jack 168 (FIG. 6) for connecting the mother board 100 to a network bus.

In addition to the above serial communications capability, the system implements an RS 232 serial communications interface 170 which is also controlled by the main communications microprocessor 112. This interface 170 is also on the mother board 100. This circuit has a programmed logic array 172 and RS 232 integrated circuit 174 coupled to a separate DB25 connector 176.

Multi-Function Board

Figure 11:
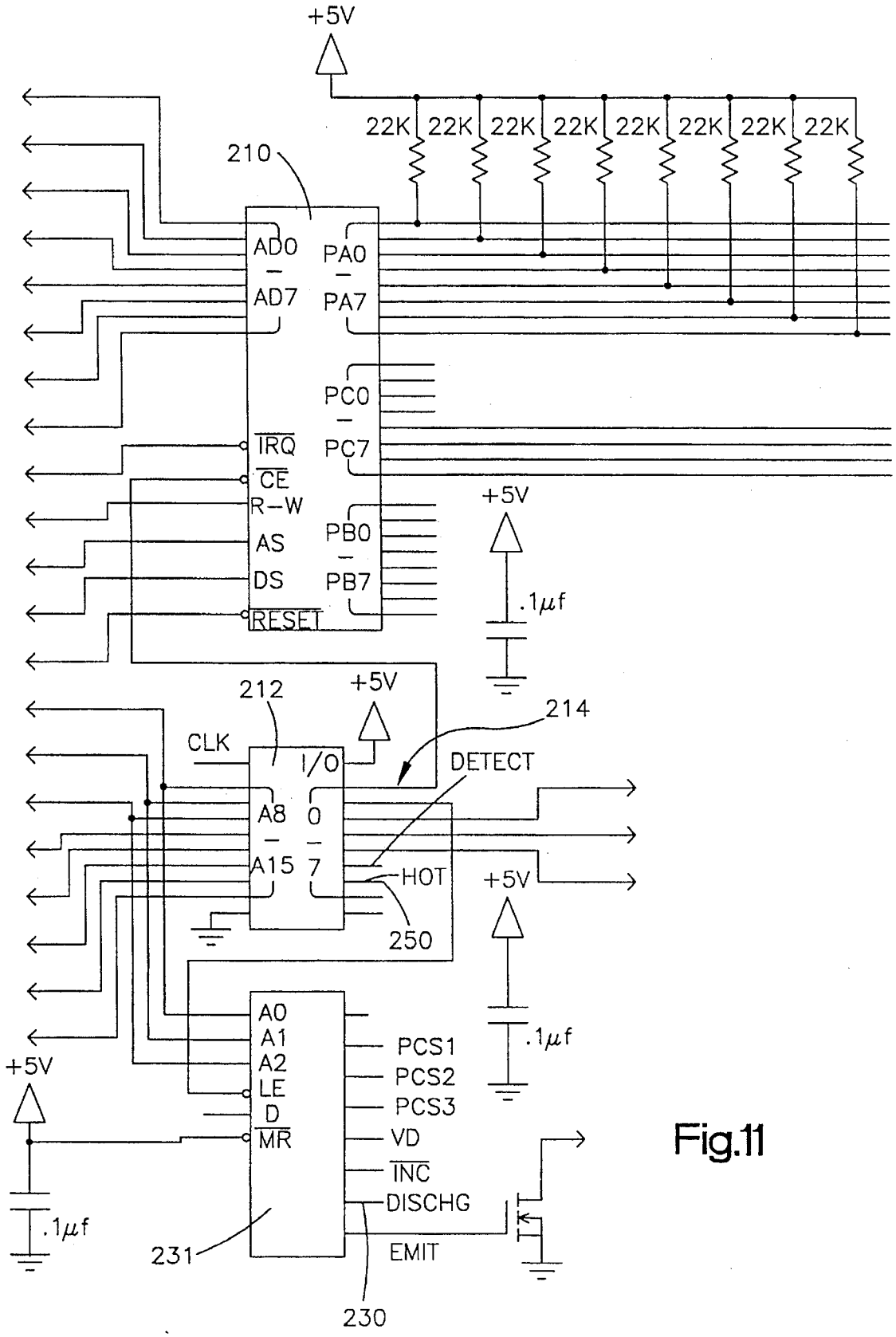
FIG. 11 is a schematic of a keyboard and display interface that allows the control microprocessor to display information and respond to user entered inputs.
Figure 12:
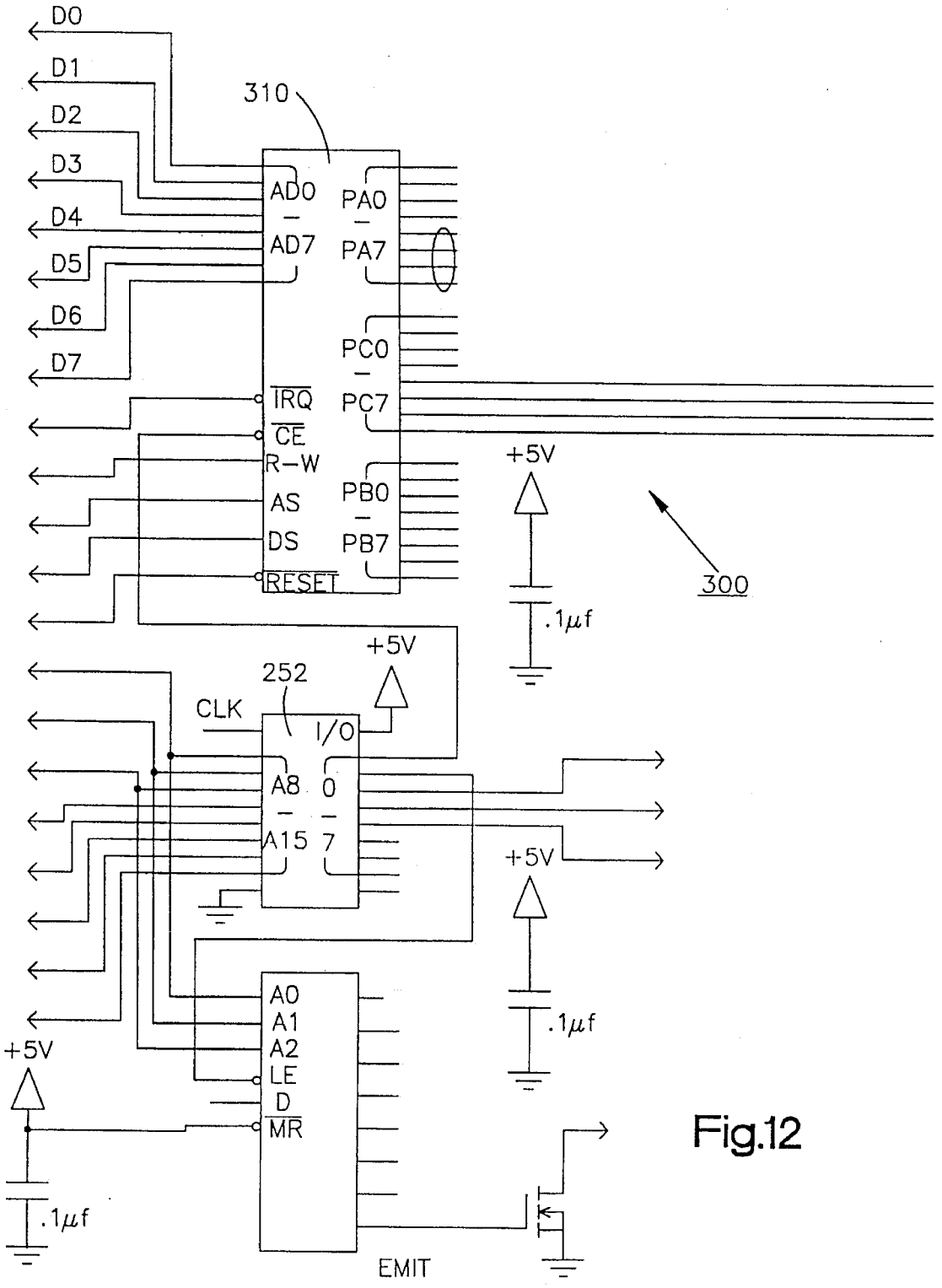
FIG. 12 is a solenoid and supply roll unwind control interface.

A multi-function daughter board 103 (FIG. 6) engages a bus slot on the mother board 100 and includes a parallel interface circuit 210 (FIG. 11) for providing standard input and output interfacing to the keyboard 72 and display 70. Pins PA0–PA7 and PC4–PC7 on the circuit 210 interface with a keyboard 72 input and pins PB0–PB7 and PC0–PC3 interface with the display 70. Pins AD0–AD7 of this circuit are coupled to the eight data bits D0–D7 of the system buss 108 and allow data to be written to and received from the keyboard and display. The circuit 210 is commercially available from Motorola as Part No. MC 146823. An 8-bit addressable latch 212 defines an I/O port 214. The latch 212 is a commercially available circuit from Motorola under Part No. 74HC259.

Figure 15:
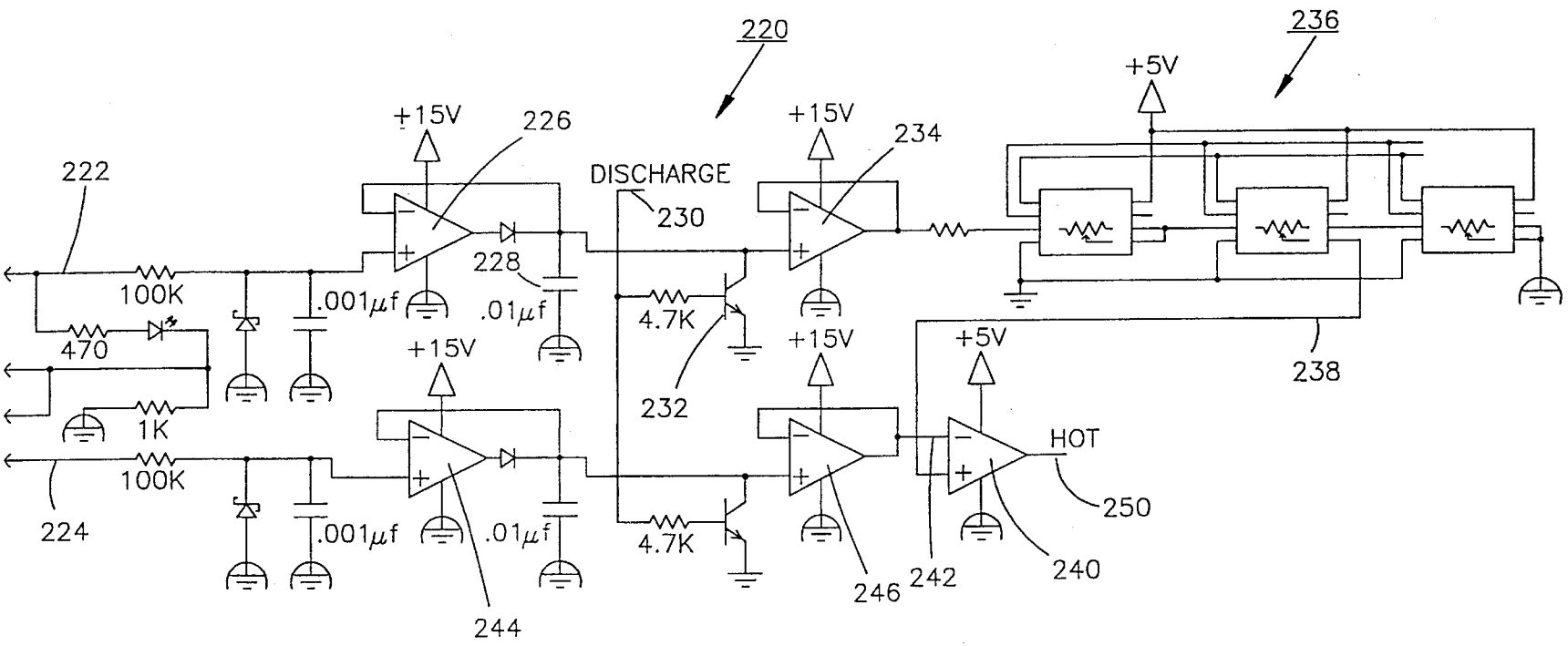
FIG. 15 is a schematic of a circuit for energizing a heating element within a seal bar to control the temperature of the seal bar as bags are sealed.

A seal control circuit 220 (FIG. 15) is also mounted to the multi-function board 103. The circuit 220 controls a seal step and is similar to the circuit disclosed in U.S. Pat. No. 5,901,506 which issued on Feb. 20, 1990 to Weyandt and is incorporated herein by reference. An input 222 to the circuit 220 is a voltage from the transformer 131. A signal at an input 224 is a signal related to sensed current through a heater wire 225*a* in a resiliently biased heater bar 225. Most preferably the heater bar 225 is spring biased to an extended position. The voltage at the transformer input 222 is coupled to a peak and hold circuit 226 which generates an output voltage that is stored on a capacitor 228 representing the peak voltage from the transformer. This voltage is discharged by the microprocessor 110 sixty times per second by activating a DISCHARGE control output 230 from a programmed array logic circuit 231 (Part No. AMD PALCE16V8) on the multi-function board 103. The discharge signal 230 turns on a transistor 232 which drains stored charge from the capacitor 228.

The peak signal passes through a buffer 234 to a voltage divider 236 having an output 238 coupled to a comparator amplifier 240. A non-inverting input to the comparator 240 is therefore a signal related to the voltage at the transformer. A signal at the inverting input 242 to the comparator 240 is a signal related to the sensed current. The sensed current input 224 passes through a peak and hold circuit 244 through a buffer amplifier 246 to the inverting input of the comparator 240. An output 250 from the comparator 240 provides an indication to the microprocessor 110 that the sealer bar has reached its cut-off temperature. The output 250 is coupled as an I/O input (I/O 6) to the latch circuit 212 connected to the buss 108. The hot signal is I/O pin 6 on the circuit 212. By monitoring this I/O signal, the microprocessor 110 knows when to de-activate the heater wire 225 by turning on an SCR represented by a switch 252 in FIG. 6.

Figure 14:
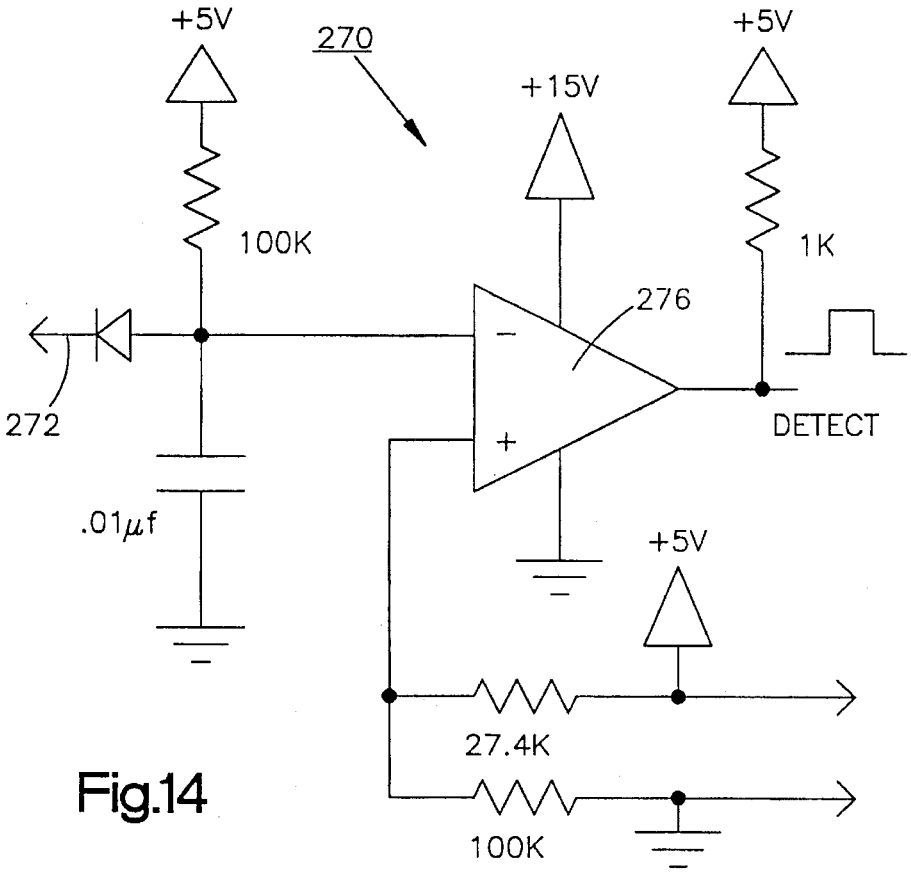
FIG. 14 is a schematic of an anti-jam circuit for monitoring sealer performance.

A circuit 270 depicted in FIG. 14 senses movement of a sealer or pressure bar 254 that engages the heater bar 225 to clamp and seal an endmost bag of the web 21. An input 272 from a photodiode 280 (FIG. 6) generates a signal when a light emitting diode signal traverses an optical path 282 originating from a light transmitter 284 mounted to the bagging head 20 near the heater bar. The size of the input 272 to an operational amplifier 276 varies with the amount of light sensed by the photodiode 280. An output from the amplifier 276 is a pulse whose width is proportional to the amplitude from the photodiode 280 and whose frequency is approximately 250 hertz. This pulse width is monitored at with a separate feed device for automated loading of the bags. The separate feed device is not shown in the drawings.

Figure 4:
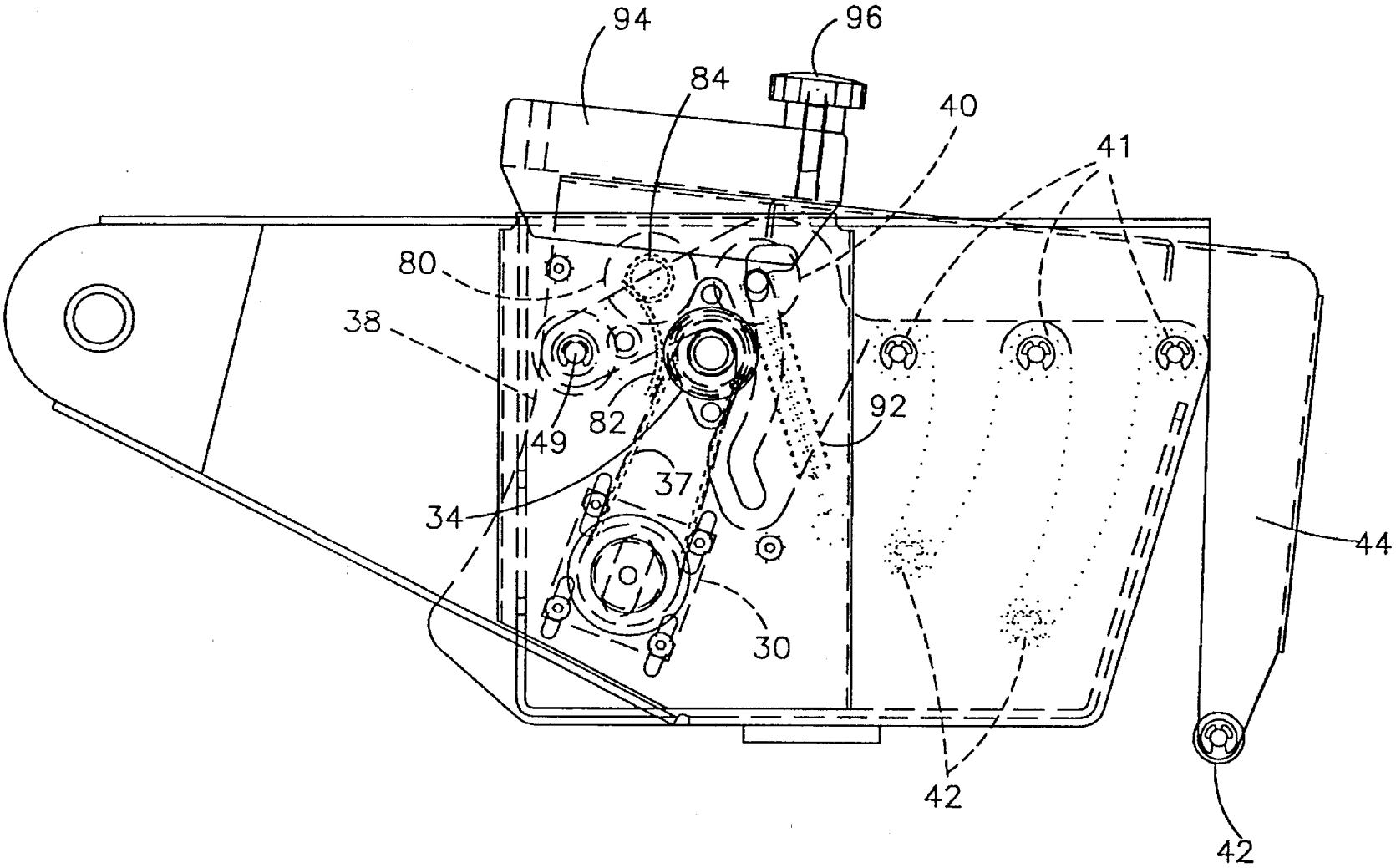
FIG. 4 is a side elevation view of the dancer assembly.

The bagging machine 10 includes two stepper motors 30, 32 which rotate associated drive rollers 34, 36 by means of drive belts 37, 39 (FIGS. 1 and 4). Actuation of the roller 34 unrolls the web 21 from the supply roll and actuation of the roller 36 advances a lead bag through the bagging head 20 to the bagging station 12. As seen most clearly in FIG. 4, as the web 21 of interconnected bags is dispensed from the supply roll 22, it is threaded over an idle roll 38 and through a nip defined by a nip roll 40 and the drive roll 34.

The web 21 is then laid over a plurality of stationary rollers 41 and tensioned by a number of dancer rolls 42 supported by a pivoting dancer roll assembly 44. The two stepper motors 30, 32 are activated individually, and the speed of the first stepper motor 30 is adjusted to maintain an average dispensing of bags from the supply roll 22 as the second stepper motor 32 incrementally advances bags through the bagging head 20, brings the leadmost bag to the bagging station 12, and waits while the loading, sealing and separating steps are performed. It is one goal of the invention to achieve stepper motor actuation which allows the first stepper motor 30 to maintain the average speed and tension within the web 21 as the stepper motor 32 incrementally advances bags to the bagging station.

The bagging head 20 includes a plurality of guide rolls (not shown) which define a web path for the web after it is dispensed from the supply roll 22 and fed through the dancer rolls assembly 44. Additional details regarding the operation and functioning of the bagging head 20 may be obtained from reference to U.S. Pat. No. 4,889,520 to Lerner et al. which issued Feb. 13, 1990 and is assigned to the present assignee. The subject matter of the '520 patent is incorporated herein by reference.

Figure 3:
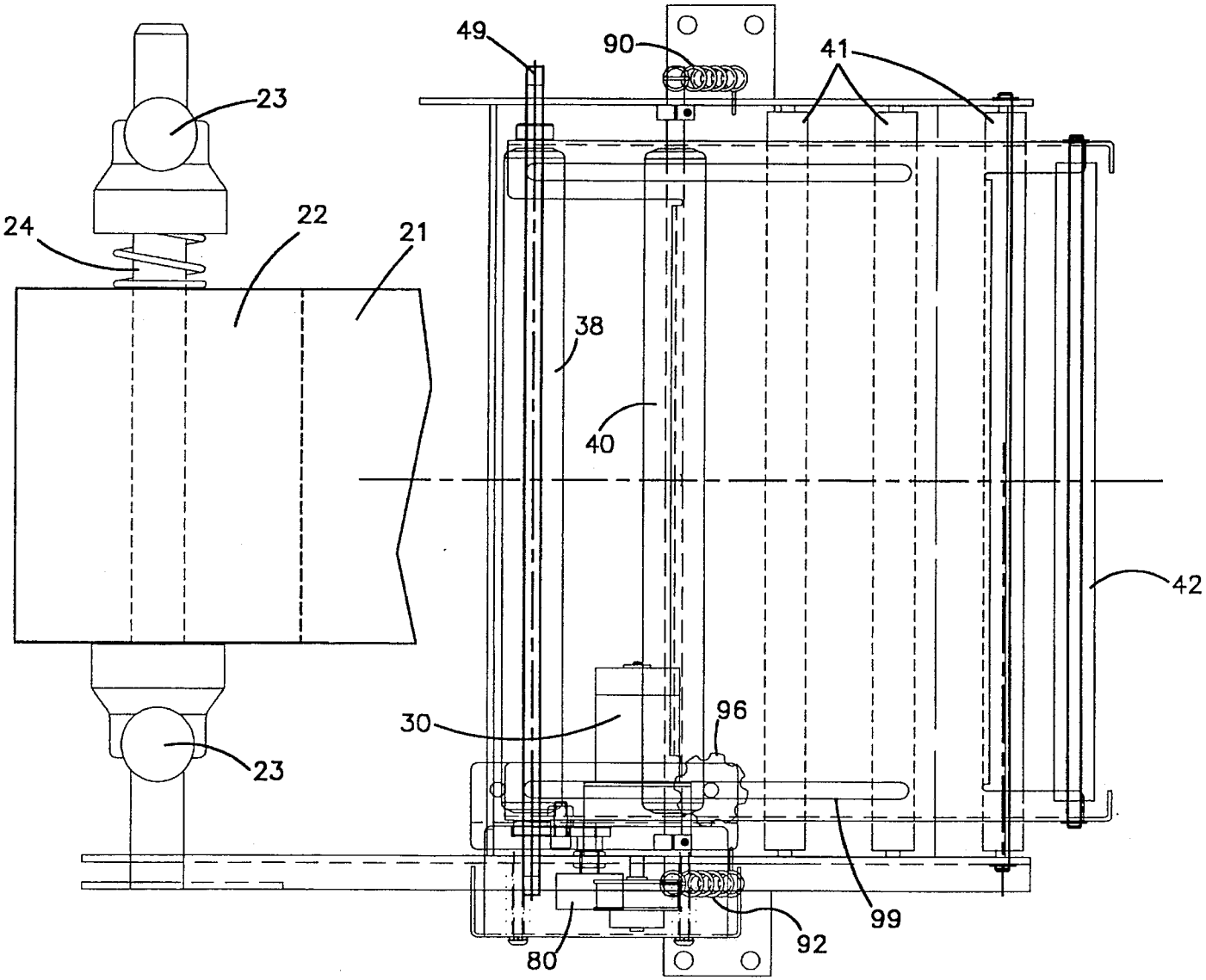
FIG. 3 is a plan view of a dancer assembly for routing a web of bags away from a supply roll mounted to a base of the FIG. 1 bagging machine.
Figure 4A:
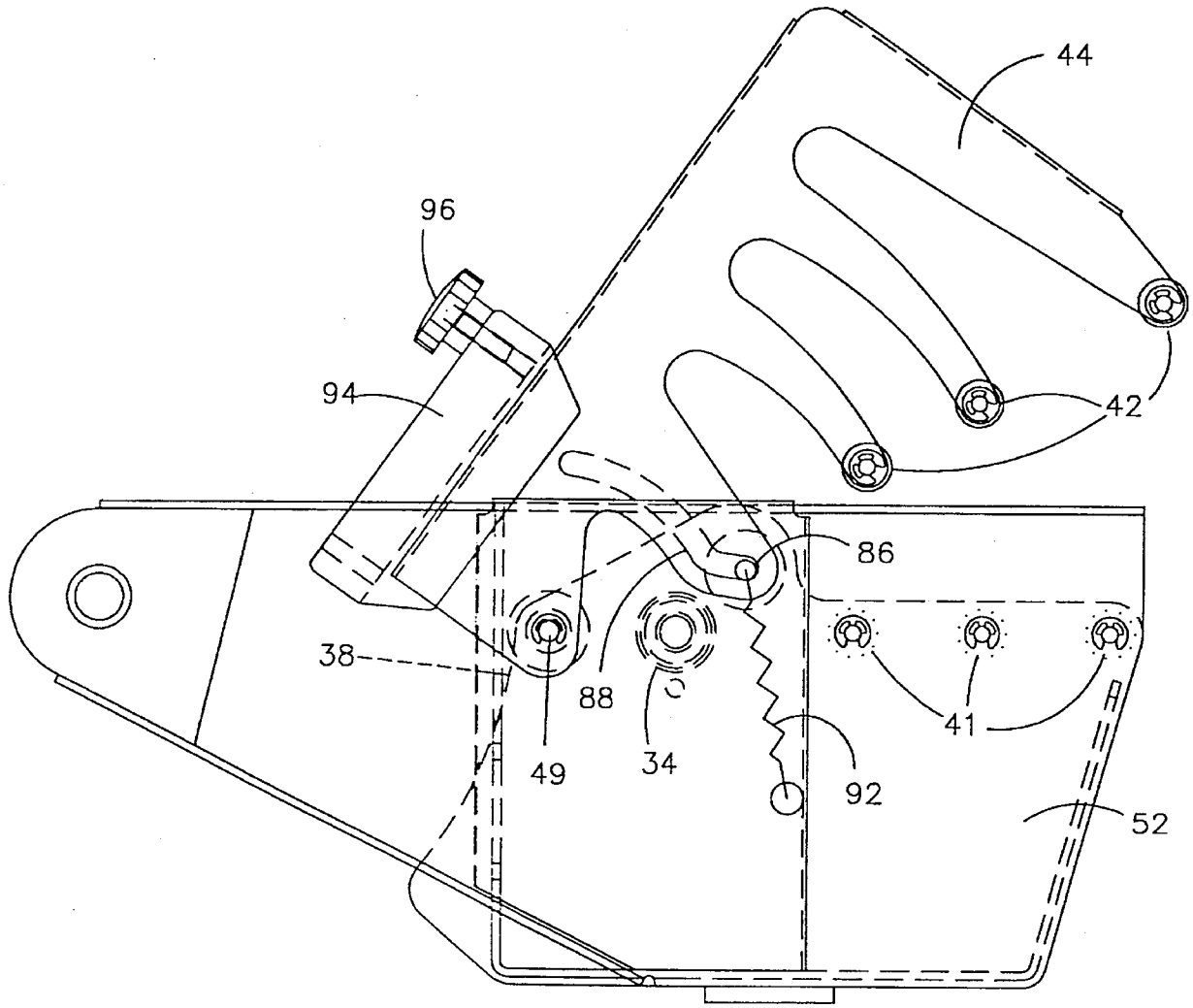
FIG. 4A is a side elevation view of the dancer assembly in a raised position.
Figure 5:
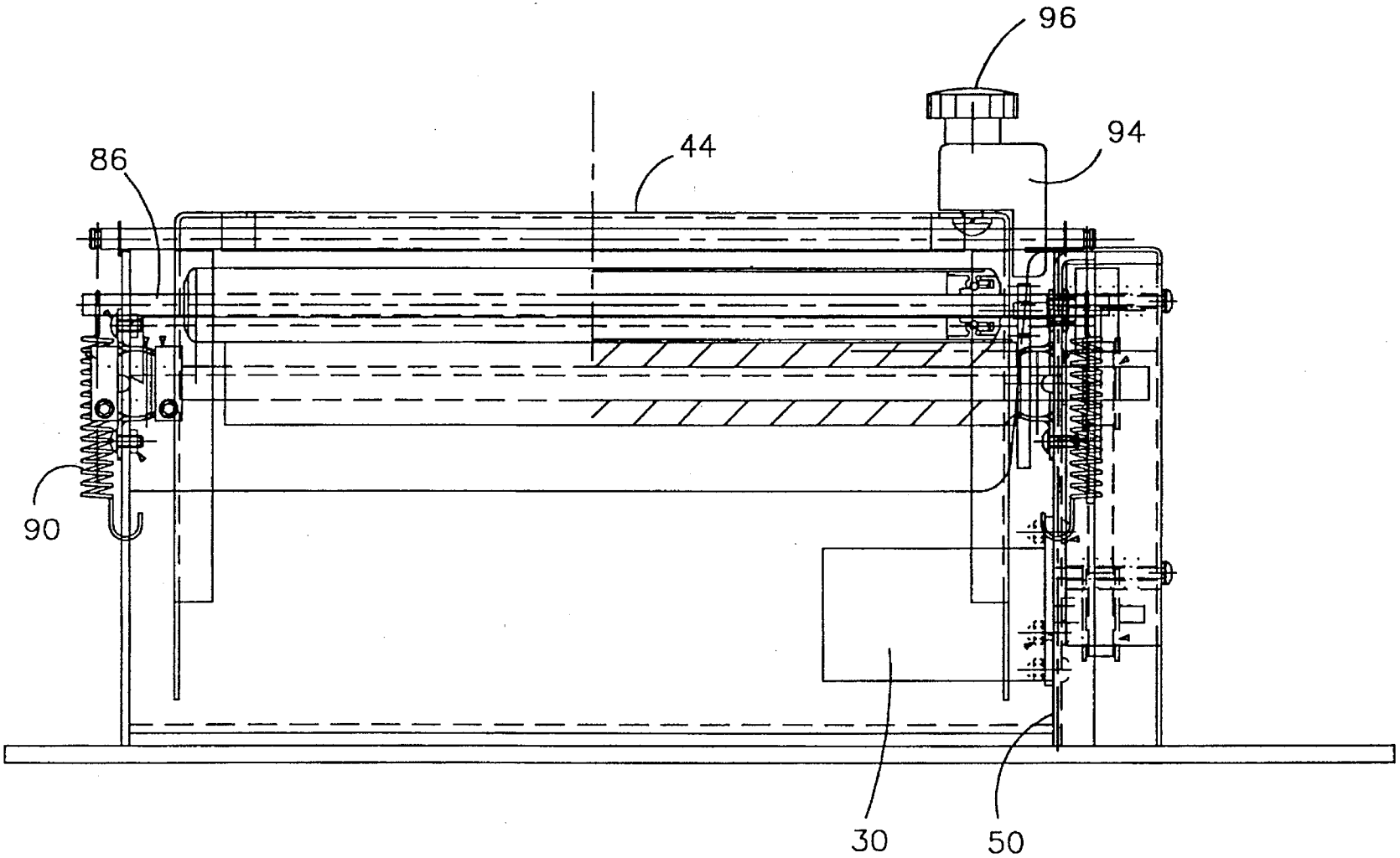
FIG. 5 is a front elevation view of the FIG. 3 dancer assembly.

Turning to FIGS. 4A and 5, the dancer roll assembly 44 is pivotally mounted to a side wall 50 of a housing 52 connected to the base 16. The assembly 44 can be rotated by the operator away from the position as shown in FIG. 3 to a raised position (FIG. 4A). The operator can then feed the web 21 from the supply roll 22, reeve it over the drive roll 34, and then lay the web over the stationary rolls 41. When the operator allows the dancer roll assembly 44 to close the dancer rolls 42 engage the web, pushing the web down through gaps between the stationary rolls 41. As seen in phantom in FIG. 4, the chain or web weaves back and forth over alternate stationary 41 and dancer rolls 42. The web 21 loops around an endmost dancer roll and, as seen in FIG. 1, is pulled up to the bagging head 20. When the pivoting dancer roll assembly 44 is closed by the operator, the nip roll 40 engages the web 21 to form the drive nip for advancing the web from the supply roll 22.

The stepper motor 32 advances the web 21 through the bagging head. As the motor 32 is actuated, the dancer roll assembly 44 is lifted by the tension in the web and pivots about the axis 49. The web tension diminishes and the dancer roll assembly falls as the drive roll 34 dispenses the web 21 from the supply roll 22.

The bagging machine 10 has a visual display 70 and keyboard input 72 (FIG. 1) that allow the user to program and monitor the status of the bagging machine's operation. A seal temperature is displayed and various options such as instantaneous number of bags per minute and the average bags per minute in a given day can be displayed. Preprogrammed bagging routines are also entered into the keyboard input 72 so that, depending on the job being run, the user can enter parameters so that the speed and incremental length of movement per bag for that job can be automatically achieved without further user control.

A potentiometer 80 mounted to the housing 52 monitors an orientation of the dancer roll assembly 44 as the web is dispensed from the roll 22. This potentiometer 80 adjusts the speed of the stepper motor 30 to match the average speed of the drive nip on the bagging head 20. This arrangement allows various intervening devices such as an imprinter for printing the bags to be attached to the bagging machine 10 between the dancer roll assembly 44 and the bagging head 20. So long as the speed of the stepper motor 30 can be controlled, the load on the web 21 is controlled and inadvertent tearing of the chain avoided. The setting on the potentiometer 80 tracks the orientation of the dancer roll assembly 44. The assembly 44 carries a gear section 82 that engages a gear 84 that rotates the potentiometer shaft.

A shaft 86 that supports the nip roll 40 moves as the dancer roll assembly 44 is pivoted out of the way. As the assembly 44 is pivoted up to load a chain of bags, the shaft 86 slides through a slot 88 in a side wall of the assembly 44 and reaches a position of equilibrium (FIG. 4A) where the shaft and slot keep the dancer roll assembly in a raised position. This equilibrium position is overcome by grasping the dancer assembly and pushing toward the closed position (FIG. 4).

As seen in FIGS. 3 and 4, the nip roll 40 is biased into engagement with the drive roll 34 by springs 90, 92. These springs include hooks that engage the shaft 86 and bias the roll 40 toward the drive roll 34. As the dancer roll assembly 44 is tilted up, the springs 90, 92 stretch to allow the web 21 to be slipped through a widened nip or gap between the drive roller 34 and nip roll 40.

In certain applications, a counterweight 94 is attached to the assembly 44. The counterweight is used principally with heavyweight web material. The counterweight 94 is secured to the dancer roll assembly 44 by a handle 96 having a threaded shaft which extends through the counterweight 94 and engages a slot 99 in the dancer roll assembly.

Figure 6:
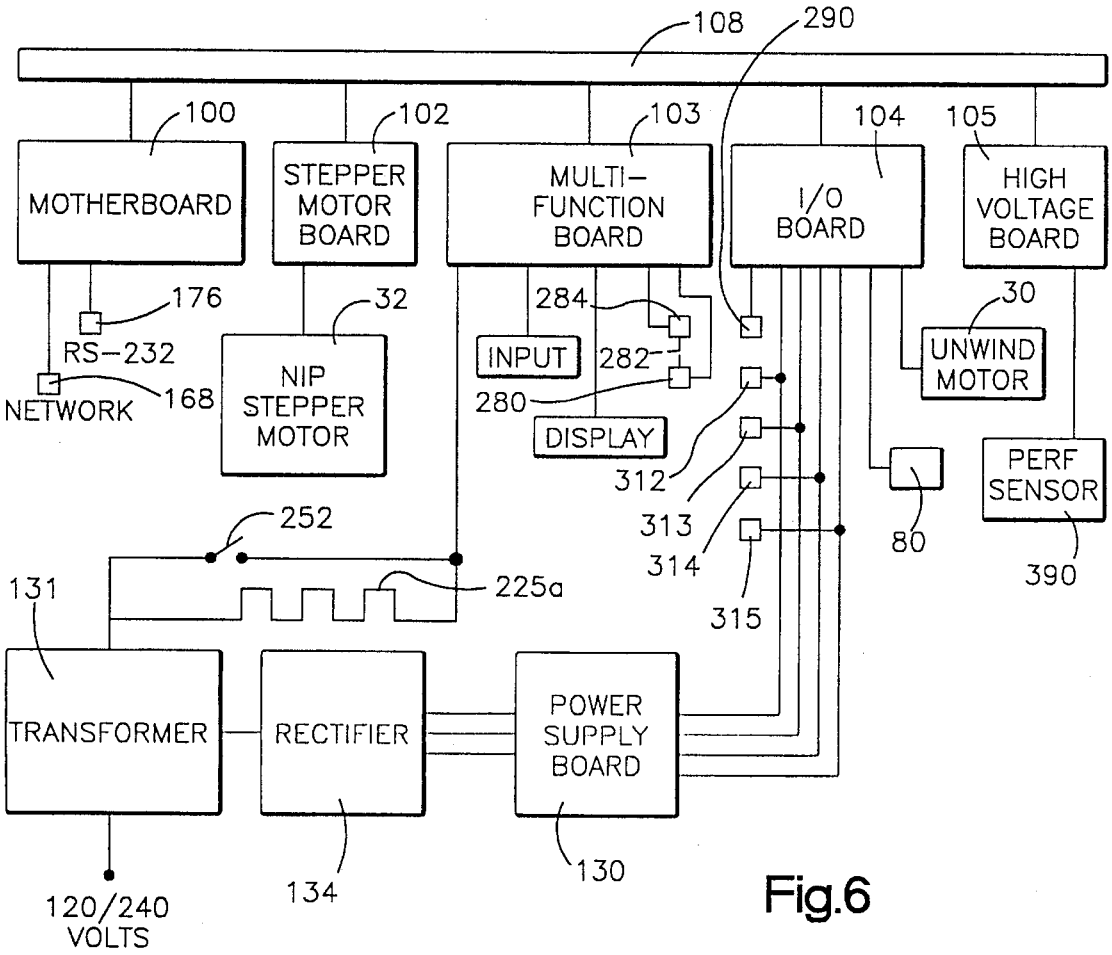
FIG. 6 is a block diagram of control electronics of the FIG. 1 bagging machine.

Control circuitry (FIGS. 6–15) for the bagging machine 10 is contained in a shielded module which can be separated from the bagging head 20 as a unit for diagnosing the control circuitry. There are expansion slots on a mother board 100 (FIG. 6) for future expansion. Four of these slots currently contain daughter cards 102–105 (FIG. 6). The design allows the cards to fit any of the available expansion slots that define a 48 pin address, data and I/O buss 108.

Mother Board

One feature of the control circuitry is the use of a communications port on the bagging machines to interconnect multiple bagging machines to each other. This allows a master control to perform set up and control operations from a central computer. The control circuitry of each bagging machine 10 includes two microprocessors 110, 112 mounted to the system mother board 100. A control microprocessor 110 (Motorola Part No. 68HC11) is depicted at the upper left portion of FIG. 7. The microprocessor 110 can access temporary data stored in a ram module 120 of 8K by 8 bits. The microprocessor accesses a control or operating system program stored in a flash PROM circuit 122 having 32 kilobytes of memory. The PROM flash PROM circuit 122 is coupled to a programmable array logic circuit 124 which decodes memory signals on an address portion of the buss 108 and activates chip select (CE) and read and write enable signals (WE, OE) on the flash ROM circuit 122.

the DETECT input to the latch circuit 212 (I/O pin 5) and used to warn the user that the optical system should be cleaned.

An absence of a DETECT pulse indicates an obstruction in the light path. If this occurs when the sealer bar is moving toward its seal position against the heater bar, a problem condition is indicated and the microprocessor 110 shuts down the bagging operation. Once the seal bar and heater bar engage a seal portion of the endmost bag, they clamp this bag. A proximity switch 290 closes just as the pressure bar engages the bag to indicate the control microprocessor should stop looking for an obstruction.

I/O Board

An I/O circuit 300 on an I/O daughter board 104 includes (FIG. 12) a second parallel interface circuit 310 that includes a number of solenoid driver circuits controlled by address selectable I/O pins PB0–PB7. A high output from these pins activates an integrated circuit (now shown) having an FET (Siemens BTS412A) and causes the output to be active. Four of the pins PB0–PB3 are controlled to actuate solenoids 312–315 (FIG. 6) on the bagging machine. The circuit 310 is coupled to the mother board buss 108 so that the control microprocessor can present an appropriate signal to the I/O circuit 300 which will in turn cause the appropriate solenoid to be activated.

Figure 7:
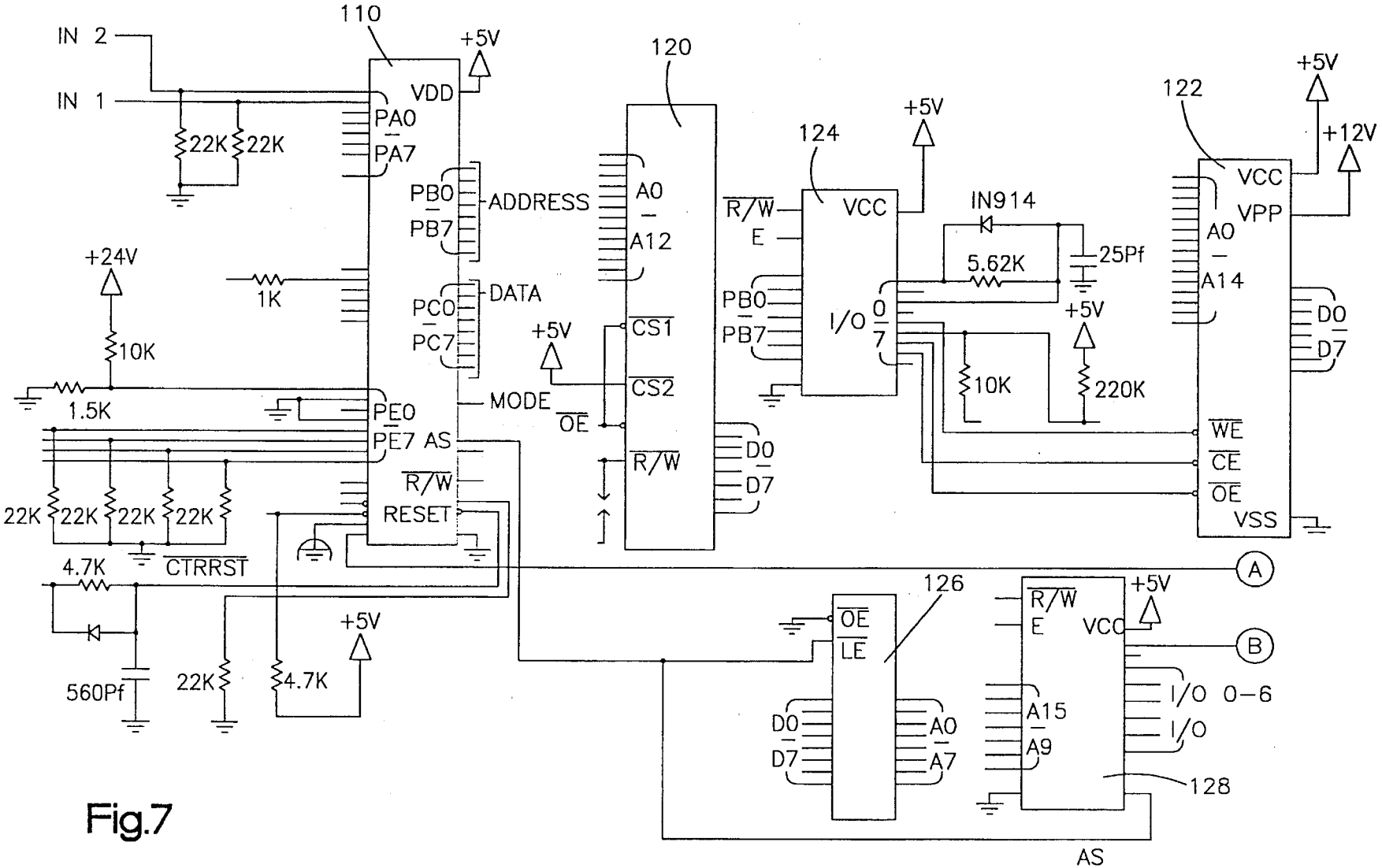
FIG. 7 is a schematic of a control microprocessor for monitoring and controlling bagging operations of the FIG. 1 bagging machine.
Figure 13:
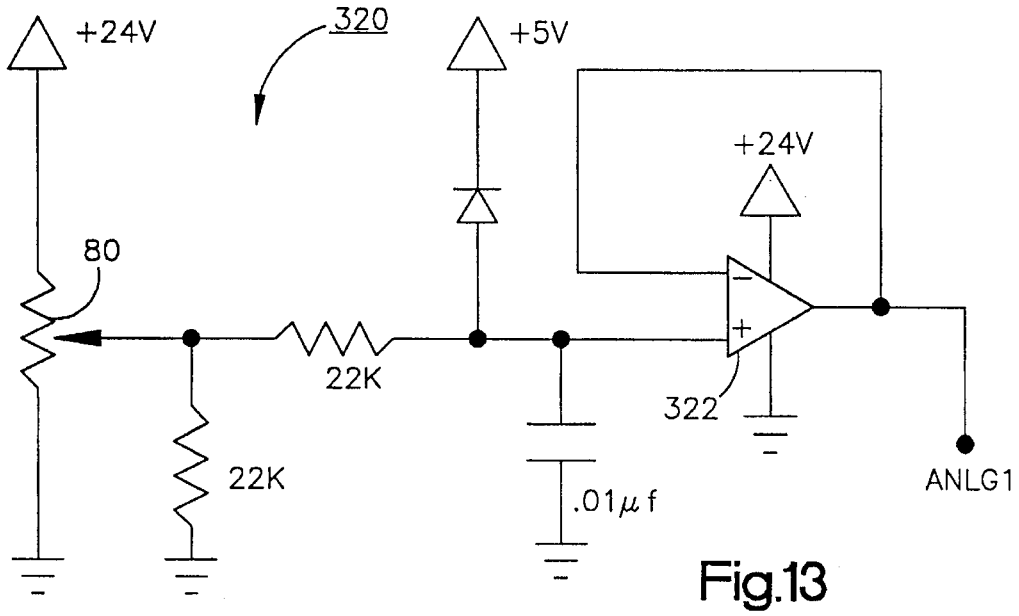
FIG. 13 is a schematic of a circuit that sends signals to the FIG. 12 interface corresponding to the dancer roll assembly orientation.

A circuit 320 depicted in FIG. 13 shows the potentiometer 80 used to monitor the dancer roll assembly 44. As the potentiometer 80 input various, a signal at the non-inverting input to an operational amplifier 322 also changes. This operational amplifier acts as a buffer to create an output which is coupled to pin 1B (Table 1) of the bus 108. Pin 1B (ANLG1) presents an analog signal representing the orientation of the dancer assembly 44 directly as an input to the microprocessor 110 (FIG. 7).

The stepper motor 30 is also controlled by the outputs from four pins (PA4–PA7) on the parallel interface circuit 310. These pins are coupled to power transistors which drive the stepper motor. By controlling these pins, the microprocessor 110 can instruct the motor 32 to speed up, slow down, maintain speed or stop.

Stepper Motor Board

A stepper motor drive circuit 330 for the motor 32 (FIGS. 10A, 10B, 10C) is carried by a plug in daughter board 102 that engages the mother board 100. When the stepper motor 32 is activated, 4 speed control signal bits S1–S4 (FIG. 10B) are presented to the stepper motor at an 8 bit addressable latch circuit 331. An on-off signal is presented as an output 332 from this latch circuit 331 and tied to an invertor circuit 333 (FIG. 10A) so that pulling the latch output low turns on the stepper motor 32. When the stepper motor is activated, it is controlled by a voltage control oscillator 334 having an external RC time constant circuit 336 for dictating the oscillation frequency. Four resistors 338*a*–338*d* which form the R portion of the RC network are coupled to the latch 331 so that by adjusting the output of the latch, the frequency of the voltage control oscillator and in turn the frequency of stepper motor actuation are controlled. When the turn on output 332 is pulled low, an RC network 340 coupled to the output of the invertor amplifier causes the stepper motor to come up to a maximum speed with an RC time constant. In a similar fashion when the turn on signal from the latch is removed, the stepper motor ramps down with an RC time constant.

Figure 10A:
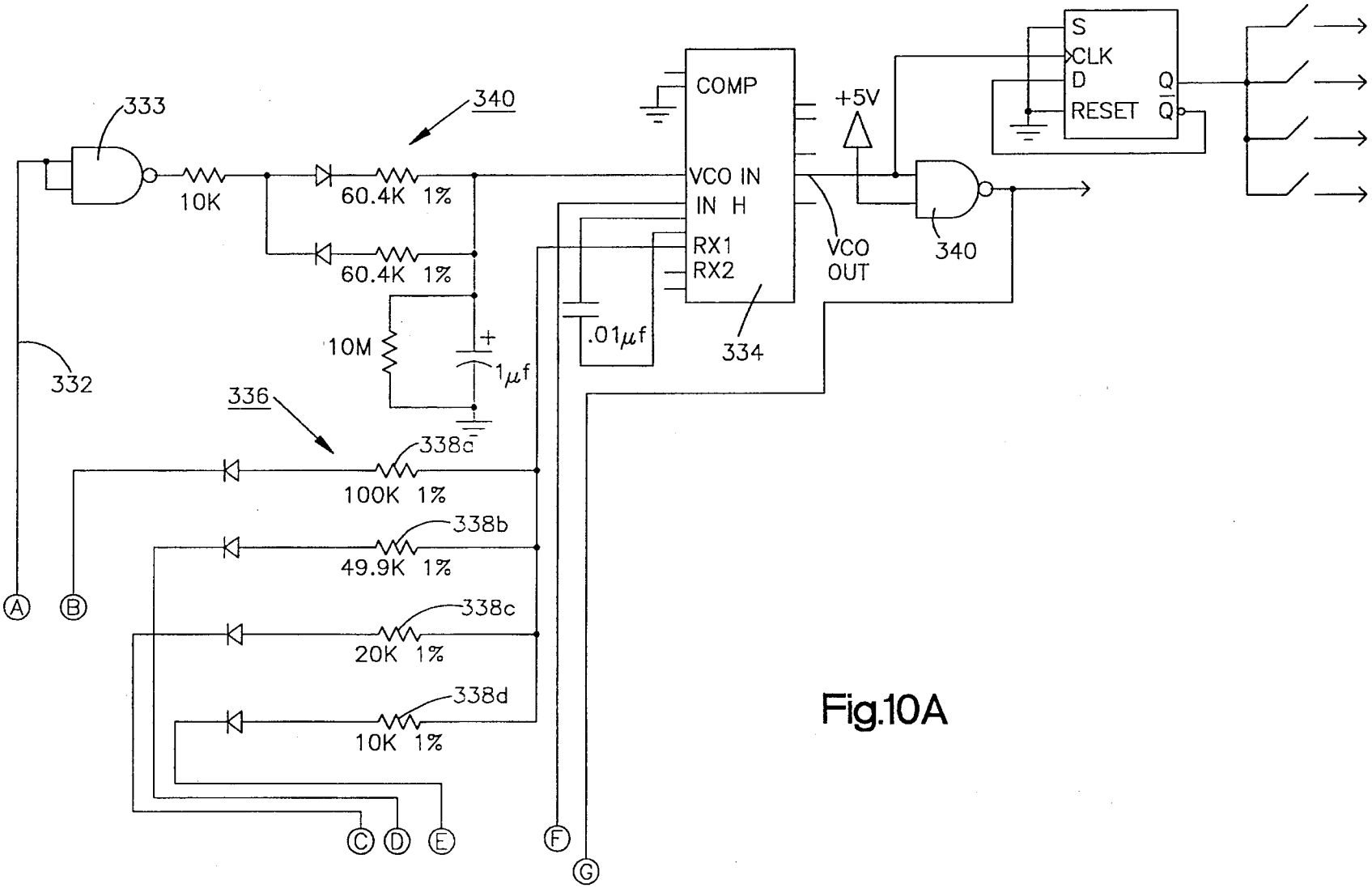
FIGS. 10A–10C are schematics of a stepper motor interface.
Figure 10B:
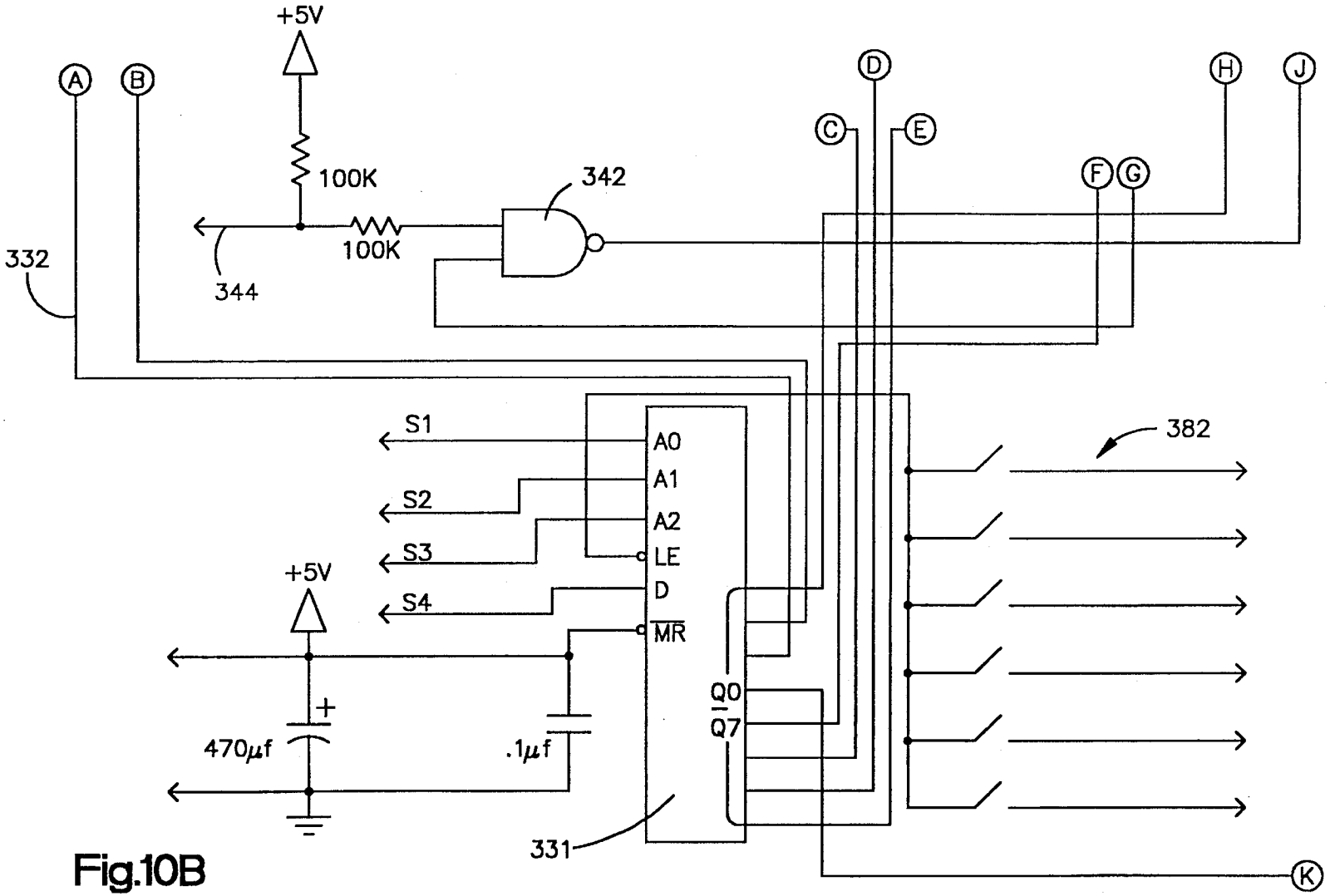

A speed output is generated by the voltage control oscillator 334 and presented as a clock input to a controller 350 through two invertor circuits 340, 342 (FIGS. 10A, 10B). The circuit 350 can be operated by either the output from the voltage control oscillator 334 or from an external circuit whose clock signal is presented as a input 344 to the invertor 342. Where two bagging machines are operated in tandem, one oscillator can control both machines by means of an output from the oscillator which is coupled to an external input 344 to the second bagging machine invertor 342.

Figure 10C:
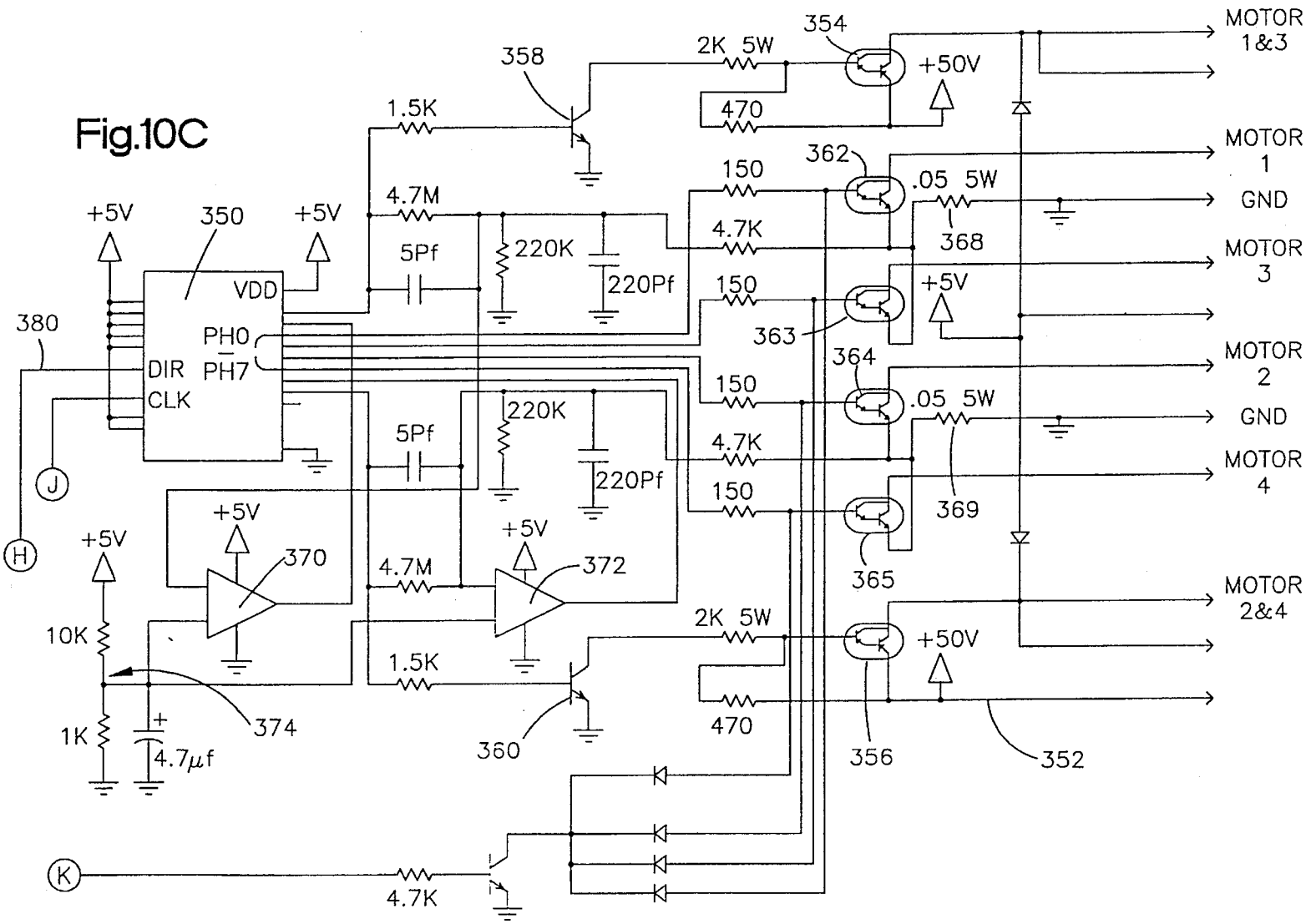

The stepper motor 32 includes a number of stepper motor windings which are activated with pulses to cause the motor to step sequentially at a controlled rate. The controller 350 for stepper motor activation is shown in FIG. 10C. The stepper motor 32 is initially given a hard pulse (high voltage) for a short duration until the current in the motor coils reaches a predetermined value. Energization of the coils continues with a substantially lower voltage for a coil pulse and then is removed. To provide the initial high-voltage pulse, a 50-volt input 352 is coupled to the motor windings through two switching transistors 354, 356. Each of the transistors has an associated control transistor 358, 360 whose conductive state is controlled by an output from the controller 350. After the initial hard pulse supplied by the transistors 354, 356 is removed, the conductive state of four additional switching transistors 362, 363, 364, 365 maintains appropriate motor coil current after the initial high-voltage energization. The conductive state of these transistors is also controlled by outputs from the controller 350.

As the high magnitude pulse is applied to a motor winding, the current through the winding is monitored and when the current reaches a specified value, the controller 350 removes the high pulse energization and reduces the energization to a lower value of five volts. To monitor winding current, two small current monitoring resistors 368, 369 couple signals generated in response to currents in the motor windings to two comparator amplifiers 370, 372 having outputs coupled to the controller 350. When current through the motor winding reaches a specified value, an associated comparator amplifier changes state informing the controller 350 that the current has reached the specified value and that an associated high-voltage transistor 354, 356 should be turned off to allow continued activation of the motor winding at a lower power value. A reference input to the two comparators 370, 372 is generated by a voltage divider circuit 374 shown in FIG. 10C.

As seen in FIG. 10C, the controller 350 includes a direction input 380 coupled to a direction output pin Q0 of the latch 331 in FIG. 10B. This instructs the controller 350 to activate the stepper motor in either direction and is set by the microprocessor 110 by writing to the latch 331. Finally, the controller 350 receives a clock input originating from the voltage controlled oscillator shown in FIG. 10A. This clock input directs the speed at which the stepper motor is activated.

The preferred controller 350 is commercially available from Anaheim Automation of Anaheim, Calif. 92801. The controller is commercially available under Part No. AA8420, and is described in a data sheet published by Anaheim Automation in April, 1986. This data sheet is incorporated herein by reference.

Returning to FIG. 10B, the stepper motor board 102 interfaces with the control/data/address buss 108 and is address selectable by adjusting the setting of a dip switch on the stepper motor board 102. The dip switch 382 is depicted in the lower right-hand portion of FIG. 10B and is coupled to the latch enable (LE) input of the latch 331.

Control Program

Figure 16:
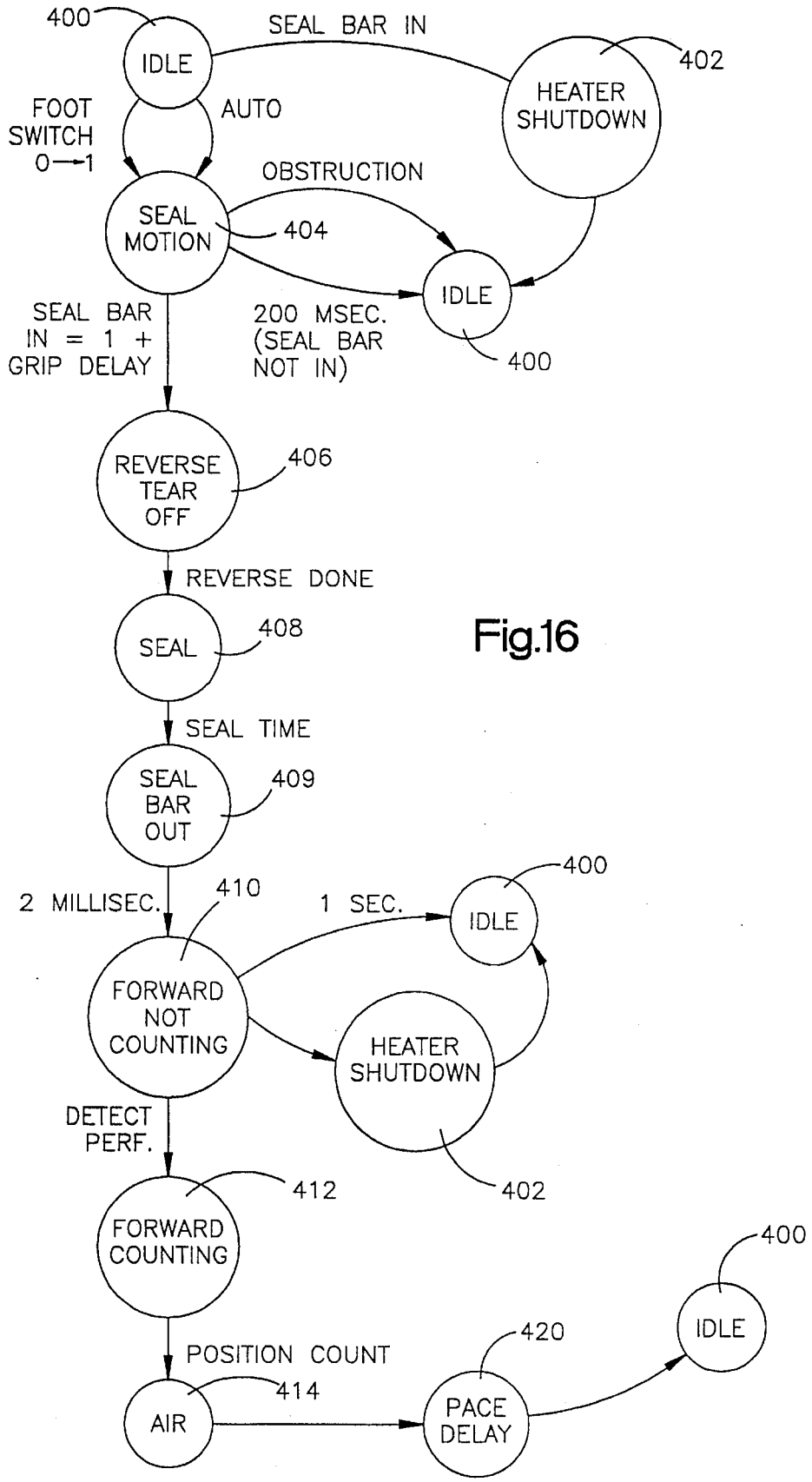
FIG. 16 is a state transition diagram for the control microprocessor depicted in FIG. 7.

The state diagram depicted in FIG. 16 shows state transitions for one task the microprocessor 110 performs while monitoring and controlling the bagging machine 10. The task depicted in FIG. 16 has a high priority so that the multi-tasking operating system that the microprocessor 110 executes branches to this task from the background task as needed.

The microprocessor 110 begins a seal, sever and load cycle at an idle state 400 and awaits a condition which causes it to leave the idle state. A most typical situation is in which the operator actuates a foot pedal indicating a loaded bag can be sealed and a next subsequent bag is to be moved into position for loading.

While in the idle state 400, if the pressure bar is sensed against the plastic web, a malfunction has occurred and the microprocessor shuts down the heater of the pressure bar at a step 402. Subsequent to shutting down the heater, the microprocessor remains in a state of inactivity until the pressure bar is again sensed away from the seal position. When this occurs, the microprocessor returns to the idle state 400.

Sensing of the pressure bar position is accomplished with the proximity switch 290 that closes when the pressure bar contacts the heater. The signal at the PC7 input to the I/O board 104 corresponds to the proximity switch state.

If the microprocessor 110 is in the idle state when the foot switch is actuated, the microprocessor 110 initiates a sealing motion step 404. If the circuit 270 senses an obstruction is in the way of the pressure bar as the pressure bar movement is initiated by the solenoid 312, the microprocessor 110 again enters the idle state in response to the obstruction. The solenoid 312 is de-actuated and the pressure bar is retracted to a spaced position by an air cylinder.

Assuming no obstruction is sensed and the seal motion is initiated, a delay is instituted (~200millisec) during which the sealing motion is assumed to take place, i.e., the pressure bar clamps the bag in place and sealing of an endmost bag begins. If the proximity switch 290 does not close, the IDLE state 400 is again entered and the pressure bar retracted.

After an appropriate delay to assume the bag is clamped, reverse actuation of the stepper motor 32 tears off the endmost bag from the chain of interconnected bags. This reverse motion step 406 is accomplished by reverse energizing the stepper motor 32 a fixed number of steps. The microprocessor then enters a state 408 in which sealing of the endmost bag occurs. The actual time for the seal is adjustable by the user by keyboard entered controls and varies between typical ranges of 0.1 and one second.

At a step 409, the microprocessor 110 de-energizes the solenoid 312 causing the pressure bar to move away from the web and waits for approximately two milliseconds to allow the air cylinder to move the pressure bar out of the way. The microprocessor then actuates 410 the stepper motor 32 causing the web to move ahead at a constant speed for an undesignated time period. Before actuating the stepper motor 32, the controller monitors the position of the pressure bar and if the pressure bar is against the seal bar shuts down 402 the heater and returns to the idle state until the pressure bar again moves out of contact with the seal bar.

If no perforation is sensed by a perforation detector 390 (FIG. 6) within one second, the forward actuation or the stepper motor 32 is suspended and the microprocessor goes to its idle state 400. If the perforations are detected by the sensor, the microprocessor enters a state 412 in which it begins counting stepper motor pulses. Assuming a perforation is sensed, the microprocessor counts a specified number of counts based upon the dimensions of the bag and actuates a solenoid 313 for blowing air into the next bag, causing the bag to open.

The bag opening step 414 is followed by a pace delay step 420. The pace delay is a built-in delay instituted in a so-called auto mode of operation. In this mode of operation, the microprocessor cycles through the various stages repetitively, allowing the worker or user to sequentially fill and move bags away from the load station. In the manual mode of operation, the pedal switch must be user actuated to proceed from the idle stage 400 to the seal motion stage 404. Thus, the microprocessor only implements the pace delay step 420 when in auto mode. After the pace delay, the microprocessor 110 enters the idle state 400. As noted above, the idle state is exited upon actuation of the foot pedal switch or, in auto mode, after a predetermined time period.

When the microprocessor is in the idle state 400, it has time to sense the setting of the potentiometer 80. In response to sensing the potentiometer, the microprocessor 110 writes to the I/O board parallel interface indicating whether the motor 32 is to speed up, slow down, maintain or stop. As the dancer roll assembly is raised by tension in the web, the web should be unwound faster so the control microprocessor 110 speeds up the motor 30. As this causes the dancer assembly to drop, the motor 30 is slowed. Representative stepper motors 30, 32 are commercially available from Applied Motions Inc.

As noted above, the microprocessor 110 executes a priority based multi-tasking system. The task of FIG. 16 has a high priority. When not executing this task, the microprocessor 110 executes lower priority tasks that include monitoring the keyboard interface and updating the bagging machine display.

Bagging Machine System

Figure 17:
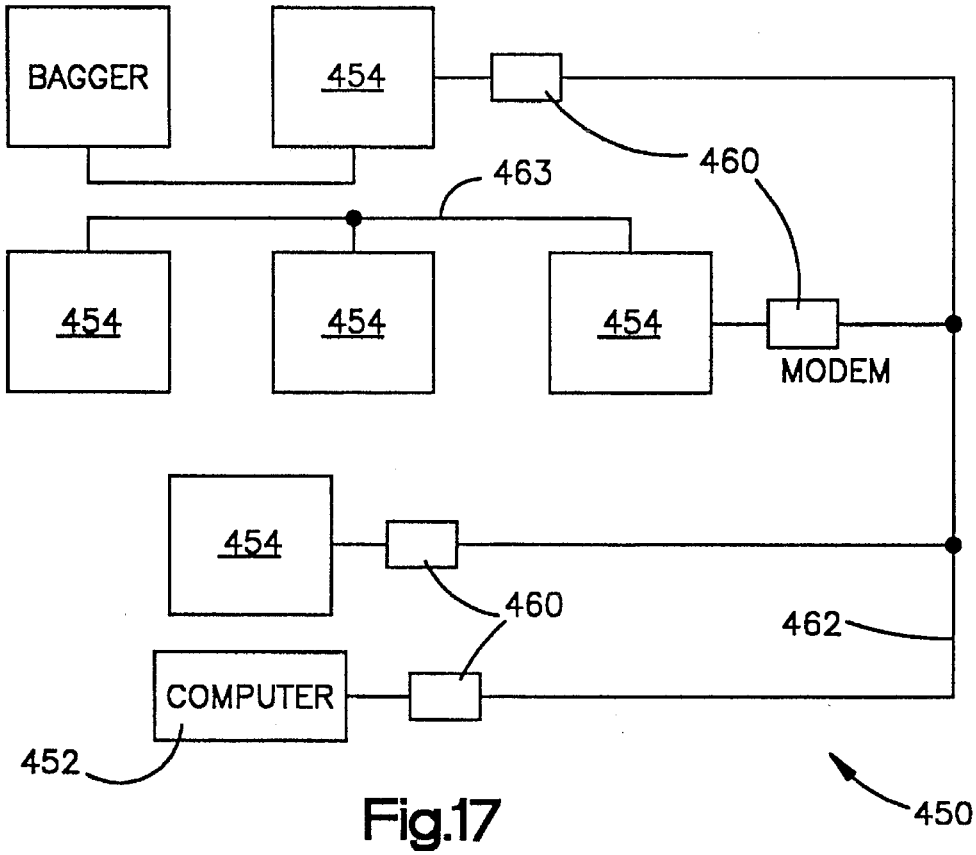
FIG. 17 is a schematic of a bagging system interconnected by a serial communications network.
Figure 18:
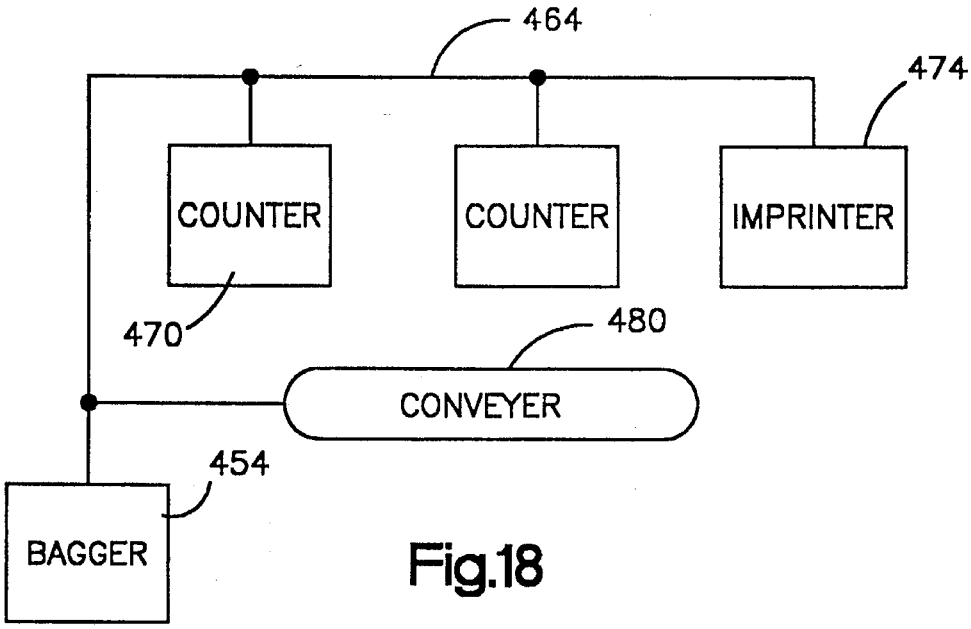
FIG. 18 is a schematic of a network control for a single bagging machine.

FIGS. 17 and 18 illustrate a bagging machine system 450 having multiple bagging machines 454 controlled by a central computer 452. Serial interconnections between the computer 452 and the multiple bagging machine 454 take place through modems 460 which transmit control signals to and from the computer 452. Each modem 460 is connected to a serial communication line 456 routed through an office or factory. Two additional local area networks 462, 464 are also depicted in FIG. 17. The network 462 interconnects three bagging machines 454 via the network connector 168 (FIG. 6) of each of those bagging machines. The network 464 interconnects two bagging machines by the same network connector.

The computer 452 could be a main frame, mini or personal computer programmed to send and receive information to and from the bagging system. This computer 452 could be used, for example, to automatically program sequences of bagging steps for certain sized bags. This would allow a supervisor to program the computer for particular sequences for each of the bagging machines 454. These would be downloaded to the bagging machine controllers 110 via the RS 232 port 176 attached to a modem 460.

FIG. 18 illustrates one bagging machine 454 and bagging peripherals used coupled together by the network 464. The network connection to the bagging system is coupled to counters and/or imprinters, as well as a conveyor system for bringing materials to be bagged to the bagger. The bagger receives control information via the RS 232 port and utilizing the network controller, sends and receives control signals to other systems on the network. Two counters 470, 472 and one bag imprinter 474 are shown in FIG. 18. Additionally, the conveyor system 480 is shown tied to the network and thus, the bagger. This allows various control signals to pass back and forth between the counter, bagger and control computer 452. Although not shown in FIG. 8, it is appreciated that multiple baggers could be coupled to the network 464.

While the present invention has been described with a degree of particularity, it is the intent that the invention include all modifications falling within the spirit or scope of the appended claims.

I claim:

1. A sealing apparatus for closing a bag-like container having two overlapping sidewalls, said sealing apparatus comprising;

a) a heat sealing unit including a heating element embedded within a resiliently biased heater bar;

b) a pressure bar, reciprocally mounted for movement towards and away from said resiliently biased heater bar, said pressure bar operative to exert a clamping force to sidewalls of a bag held between said resiliently biased heater bar and said pressure bar;

c) a solenoid coupled to the pressure bar for controlling movement of the pressure bar in response to a solenoid activation signal;

d) an optical sensor for sensing an obstruction in a space between said heater bar and said pressure bar and generating a sensor output signal in response to a sensing of an obstruction;

e) a proximity switch that changes state as the pressure bar engages a bag to clamp the bag against the heater bar;

f) a programmable controller coupled to the solenoid for outputting a solenoid activation signal and coupled to said optical sensor and operative to monitor the sensor output signal and remove the solenoid activation signal to cause said pressure bar to retract to a spaced positioned upon sensing an obstruction before said pressure bar has moved to a position to activate the proximity switch; and, g) said programmable controller further coupled to the sealer element embedded within the sealer bar for controlling a temperature of the heating element.

2. The sealing apparatus of claim 1 additionally comprising a limit switch for sensing when the pressure bar has contacted an endmost bag of a chain of interconnected bags and wherein the programmable controller monitors a change in state of the limit switch to determine that the endmost bag has been clamped.

3. The sealing apparatus of claim 2 wherein the programmable controller comprises a timer that times an interval between actuation of the solenoid and sensing a change in state of the limit switch and wherein the programmable controller deactivates the solenoid if the change in state of the limit switch does not occur within a set time interval.

4. A method of sealing a bag-like container after it has been loaded with product, said method comprising the steps of:

a) moving an endmost bag to a bagging station and loading product into the endmost bag;

b) clamping a seal portion of the endmost bag between a resiliently biased sealer bar and a moveable pressure bar by moving the pressure bar into contact with the seal portion of said endmost bag;

c) causing a light beam to pass through a region between said sealer bar and said pressure bar, sensing receipt of the light beam by a receiver, and causing said pressure bar to retract to a spaced position upon sensing an obstruction in a region between the seal and pressure bars as indicated by a change in an output from the receiver before said pressure bar has moved to a clamping position with respect to said sealer bar;

d) confirming that the pressure bar has clamped the seal portion of the endmost bag and controlling a temperature of a heating element associated with said sealer bar during a seal time interval.

5. The method of claim 4 where the step of moving the pressure bar into contact with the endmost bag is timed and if the confirming step is not made within a specified period, the pressure bar is moved back to an initial position spaced from the heater bar.

6. The method of claim 4 where the confirming step is performed by using a proximity switch to sense movement of the pressure bar.

7. A packaging apparatus comprising:

a) structure establishing a path of travel for a packaging web comprising at least one longitudinal chain of interconnected, bag-like containers, contiguous containers being interconnected with each other along a transverse line of weakness;

b) a web drive system including a nip roll assembly having a feed roller and a pinch roller and a motor for selectively actuating the feed roller of said nip roll assembly to selectively advance said associated web;

c) a sealing mechanism for closing said bag-like containers after loading including:

i) a heat sealing unit including a heating element embedded within a spring biased heater bar;

ii) a pressure bar, reciprocally mounted for movement towards and away from said heater bar, said pressure bar operative to exert a clamping force to a container held between said sealing bar and said pressure bar;

iii) an optical sensor for monitoring a region between said heater bar and said pressure bar and for generating an output signal if an obstruction is sensed between the heater bar and the pressure bar; and iv) a solenoid coupled to the pressure bar for controlling movement of the pressure bar in response to a solenoid activation signal;

d) a programmable controller for co-ordinating movement of the web with movement of the pressure bar; said programmable controller coupled to solenoid for initiating movement of the pressure bar and coupled to the optical sensor for monitoring said sensor output signal and deactivating the solenoid to cause said pressure bar to retract to a spaced position if the sensor senses an obstruction between said heater bar and said pressure bar before said pressure bar is moved to a predetermined position with respect to said sealer bar.

* * * * *